US008550333B2

(12) United States Patent
Emmott

(10) Patent No.: US 8,550,333 B2
(45) **Date of Patent: *Oct. 8, 2013**

(54) APPARATUS FOR FASTENING AND/OR SEPARATING CONTAINER PORTIONS

(76) Inventor: Gary G. Emmott, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/212,600

(22) Filed: Aug. 18, 2011

(65) Prior Publication Data

US 2012/0031959 A1 Feb. 9, 2012

Related U.S. Application Data

(63) Continuation of application No. 11/891,340, filed on Aug. 10, 2007, now Pat. No. 8,020,751, which is a continuation-in-part of application No. 11/326,883, filed on Jan. 6, 2006, now abandoned, which is a continuation of application No. 10/784,504, filed on Feb. 23, 2004, now Pat. No. 6,983,875.

(60) Provisional application No. 60/450,056, filed on Feb. 25, 2003, provisional application No. 60/837,121, filed on Aug. 11, 2006.

(51) Int. Cl.

| | |
|---|---|
| ***B65D 27/34*** | (2006.01) |
| ***B65D 27/04*** | (2006.01) |
| ***B65D 25/54*** | (2006.01) |

(52) U.S. Cl.

USPC ..... 229/313; 229/71; 229/162.3

(58) Field of Classification Search

USPC ..... 229/313–316, 70, 303, 304, 162.3, 229/125.05, 125.15, 71

See application file for complete search history.

(56) References Cited

U.S. PATENT DOCUMENTS

| | | | |
|---|---|---|---|
| 190,630 | A | 5/1887 | Simonson |
| 443,611 | A | 12/1890 | Dubey |
| 576,552 | A | 2/1897 | Cook |
| 579,467 | A | 3/1897 | Brevard |
| 638,561 | A | 12/1899 | Cook |
| 811,092 | A | 1/1906 | Roberts |
| 1,065,012 | A | 6/1913 | Watanabe |
| 1,073,056 | A | 9/1913 | McFarlane |
| 1,106,721 | A | 8/1914 | Lewis |
| 1,791,352 | A | 2/1931 | Colonnese |
| 1,963,639 | A | 6/1934 | Ahlquist |
| 2,001,340 | A | 5/1935 | Bear et al. |
| 2,083,158 | A | 6/1937 | Ramsey |
| 2,128,196 | A | 8/1938 | Vogel |
| 2,129,705 | A | 9/1938 | Reineman |

(Continued)

FOREIGN PATENT DOCUMENTS

| | | | |
|---|---|---|---|
| GB | 12386 | | 0/1894 |
| GB | 2195979 | A * | 4/1988 |

*Primary Examiner* — Jes F Pascua

(74) *Attorney, Agent, or Firm* — Fraser Clemens Martin & Miller LLC; William J. Clemens

(57) ABSTRACT

An apparatus for at least partially separating at least two container portions includes first and second container portions. At least one tear line extends at least partially between the first and second portions and at least partially defines the first portion. The first portion is at least partially separable from the second portion along the tear line(s). At least one releasable adhesive spot at least partially holds the first portion down prior to the at least partial separation of the first portion from the second portion.

15 Claims, 33 Drawing Sheets

(56) References Cited

U.S. PATENT DOCUMENTS

| | | | | | |
|---|---|---|---|---|---|
| 2,131,575 | A | | 9/1938 | Whipple | |
| 2,330,666 | A | | 9/1943 | Berkowitz | |
| 2,363,957 | A | | 11/1944 | Goff | |
| 2,476,740 | A | | 7/1949 | Krall | |
| 2,535,537 | A | | 12/1950 | Heywood | |
| 2,828,060 | A | | 3/1958 | Brown | |
| 2,828,065 | A | * | 3/1958 | Heywood | 229/316 |
| 2,973,086 | A | * | 2/1961 | Thompson | 206/767 |
| 3,173,599 | A | | 3/1965 | Silver | |
| 3,187,976 | A | | 6/1965 | Struble | |
| 3,270,941 | A | * | 9/1966 | Barnes | 229/212 |
| 3,281,054 | A | | 10/1966 | Buttery | |
| 3,295,743 | A | | 1/1967 | Redpath et al. | |
| 3,298,595 | A | | 1/1967 | Collura | |
| 3,322,329 | A | | 5/1967 | Castaneda et al. | |
| 3,392,905 | A | | 7/1968 | Caldwell | |
| 3,409,445 | A | | 11/1968 | Hall | |
| 3,420,432 | A | | 1/1969 | Cooper | |
| 3,423,005 | A | | 1/1969 | Leibson et al. | |
| 3,491,937 | A | | 1/1970 | Brasted | |
| 3,512,702 | A | | 5/1970 | Pritchard | |
| 3,595,466 | A | | 7/1971 | Rosenburg, Jr. | |
| 3,900,642 | A | | 8/1975 | Michel | |
| 3,960,315 | A | | 6/1976 | Dobbins | |
| 4,166,538 | A | | 9/1979 | Nixon et al. | |
| 4,192,448 | A | | 3/1980 | Porth | |
| 4,271,964 | A | | 6/1981 | Train | |
| 4,373,661 | A | | 2/1983 | Lundquist et al. | |
| 4,417,678 | A | | 11/1983 | Roccaforte | |
| 4,436,206 | A | | 3/1984 | Kuchenbecker | |
| 4,548,318 | A | | 10/1985 | Boyle | |
| 4,566,627 | A | | 1/1986 | Gendron | |
| 4,746,052 | A | | 5/1988 | Schmissrauter | |
| 5,009,518 | A | | 4/1991 | Faltynek | |
| 5,052,613 | A | | 10/1991 | Lin | |
| 5,259,550 | A | | 11/1993 | Kuchenbecker | |
| 6,695,144 | B2 | | 2/2004 | Freeze | |
| 6,983,875 | B2 | | 1/2006 | Emmott | |
| 8,020,751 | B1 | * | 9/2011 | Emmott | 229/313 |
| 2002/0104778 | A1 | | 8/2002 | Lux et al. | |

* cited by examiner 20
30
32
32a
32b
32c
34
36
36a
36b

APPARATUS FOR FASTENING AND/OR SEPARATING CONTAINER PORTIONS

CROSS-REFERENCE TO RELATED APPLICATIONS

This application is a continuation application of U.S. patent application Ser. No. 11/891,340 filed Aug. 10, 2007 and entitled "Apparatus for Fastening and/or Separating Container Portions", which issued as U.S. Pat. No. 8,020,751 on Sep. 20, 2011, which is a continuation-in-part application of U.S. patent application Ser. No. 11/326,883 filed Jan. 6, 2006 now abandoned and entitled "Apparatus for Fastening and Separating Containers", which is a continuation of U.S. patent application Ser. No. 10/784,504 filed Feb. 23, 2004 and entitled "Apparatus for Fastening and Separating Containers", which issued as U.S. Pat. No. 6,983,875 on Jan. 10, 2006 and claims the benefit of U.S. Provisional Patent Application Ser. No. 60/450,056 filed Feb. 25, 2003 and entitled "Connecting and/or Separating Mechanism". This application also claims the benefit of U.S. Provisional Patent Application Ser. No. 60/837,121 filed Aug. 11, 2006 and entitled "Apparatus, Articles of Manufacture and Methods for Opening Containers."

BACKGROUND

The present disclosure relates to apparatus, articles of manufacture and methods relating to fastening and/or separating container portions.

Many containers, such as envelopes, re-usable envelopes, pockets, carriers, cartons, boxes, folded forms, greeting cards, packaging, brochures, booklets, magazines and mailers, are designed to be sealed or fastened and thereafter opened or separated. Various problems and inefficiencies are associated with the sealing and/or subsequent opening of containers. For example, unsealing or opening of the item is often difficult, messy or damaging to the item. Attempts at solving the problems and inefficiencies associated with fastening and separating such items have proven unsatisfactory.

Accordingly, there exists a need for apparatus, methods and articles of manufacture for fastening and separating containers having one or more of the following attributes, capabilities or features: allows for easy release, separation or opening of connected container portions; limits, minimizes or eliminates damage to container portions being separated; reduces, limits, eliminates or controls tearing of container portions during separation; reduces, limits, eliminates or controls tearing of container portions during separation regardless of the direction of separation of the connected container portions; reduces, limits, eliminates or controls tearing of container portions during separation when the connected container portions are separated in a particular direction; indicates tampering or attempted opening of connected container portions; prevents or reduces damage to text or graphics included on one or more connected/separated container portion(s); provides an intuitive mechanism for opening or separating connected container portions; makes opening containers easier; provides simple, dependable, easy-open functionality for containers; preserves the appearance and/or integrity of connected container portions after separation; provides desired sturdiness of affixation/separation mechanisms; eliminates the need for equipment to open certain containers or separate connected container portions; enables re-use, resealing or remailing of containers; prevents accidental opening of perforations on containers; allows for easy connection of container portions; removes or reduces uncertainty in determining the quantity and extent of affixation material to include on container portions to be connected; enables the manufacture, sealing and use of containers with less affixation material; simplifies the manufacturing process of containers; removes or reduces potential difficulties in processing and/or handling containers; allows for easy use of container manufacturing and handling equipment, such as high-speed envelope insertion and sealing equipment.

BRIEF SUMMARY OF THE INVENTION

Various embodiments of the present disclosure involve apparatus for at least partially separating at least two container portions of at least one container. The apparatus includes a first container portion that includes at least one section constructed at least partially of a fibrous material. A second container portion includes a cut-out formed by at least one edge of the second container portion. At least one tear line extends at least partially between the first and second container portions and at least partially defines the first container portion. The tear line is disposed in at least close proximity to at least one edge of the second container portion that forms the cut-out. At least one patch extends at least partially across the cut-out and is partially secured to the second container portion, but is unsecured to the second container portion proximate to the first container portion. At least one adhesive spot is disposed upon at least one among the first container portion and the patch proximate to the cut-out. The adhesive spot is releasably engageable between the patch and the section of the first container portion that is constructed at least partially of a fibrous material. The first container portion is releasable from the patch at the adhesive spot and at least partially separable from the second container portion along the tear line(s).

In some embodiments, the present disclosure involves apparatus for at least partially separating at least two container portions of at least one container that includes an opening and a closure mechanism for covering the opening. A first container portion extends at least partially in the direction of the opening of the container. A second container portion includes a cut-out formed by at least one edge of the second container portion. At least one patch extends at least partially across the cut-out. The patch is secured to the second container portion on at least one side, but is unsecured to the second container portion on the side facing the opening of the container. At least one tear line is disposed in at least close proximity to the edge of the second container portion that forms the cut-out and extends in the direction of the opening of the container. The tear line at least partially defines the first container portion. At least one adhesive spot is disposed upon the first container portion and/or the patch. The adhesive spot is capable of at least temporarily adhering together the first container portion and the patch proximate to the cut-out. The first container portion is releasable from the patch at the at least one adhesive spot and at least partially separable from the second container portion along the tear line(s).

There are embodiments of the present disclosure that involve an apparatus for at least partially separating at least two container portions of at least one container. The apparatus includes a first container portion having at least one section constructed at least partially of a fibrous material. A second container portion includes a cut-out formed by at least one edge of the second container portion. At least one patch extends at least partially across the cut-out. At least one tear line at least partially defines the first container portion and at least partially aligns with at least one edge of the second container portion that forms the cut-out. At least one adhesive spot is disposed upon at least one among the first container portion and the patch and is releasably engageable between the patch and the section of the first container portion that is constructed at least partially of a fibrous material. The first container portion is releasable from the patch at the adhesive spot and at least partially separable from the second container portion along the tear line. Separation of the first container portion from the second container portion forms an extension of the cut-out.

Many embodiments of the present disclosure involve an apparatus for at least partially separating at least two container portions of at least one container. The apparatus includes a first container portion having at least one section constructed at least partially of a fibrous material. A second container portion includes a cut-out formed by at least one edge of the second container portion. At least one tear line at least partially defines the first container portion and at least partially aligns with at least one the edge of the second container portion that forms the cut-out. At least one adhesive spot is disposed upon at least one among the first container portion and at least one other portion of the container, and is releasably engageable between the section of the first container portion that is constructed at least partially of a fibrous material and the other portion of the container. The first container portion is at least partially separable from the second container portion along the tear line. Separation of the first container portion from the second container portion enlarges the cut-out.

Various embodiments of the present disclosure involve an apparatus for at least partially separating at least two container portions of at least one container. The apparatus includes a first container portion having at least one section constructed at least partially of a fibrous material. A second container portion includes a cut-out formed by at least one edge of the second container portion. At least one tear line at least partially defines the first container portion. The first container portion is at least partially separable from the second container portion along the tear line. At least one adhesive spot is disposed upon at least one among the first and second container portions proximate to the cut-out, and is releasably engageable between the second container portion and the section of the first container portion that is constructed at least partially of a fibrous material. At least one weakened area is formed into the first container portion and associated with the adhesive spot. The weakened area is capable of assisting in easing the separation and release of the first and second container portions proximate to the adhesive spot.

Some embodiments of the present disclosure involve apparatus for fastening together and allowing the separation of at least first and second container portions of at least one container. The apparatus includes at least one adhesive spot disposed upon the first container portion. The adhesive spot is capable of at least temporarily fastening together the first and second container portions at the location of the adhesive spot. At least one weakened area is formed into the first container portion. The weakened area includes at least one cut disposed adjacent to the adhesive spot on the trailing side of the adhesive spot and at least one cut extending through the adhesive spot.

Accordingly, the present invention includes features and advantages which are believed to enable it to advance container connecting and/or separation technology. Characteristics and advantages of the present invention described above and additional features and benefits will be readily apparent to those skilled in the art upon consideration of the following detailed description of preferred embodiments and referring to the accompanying drawings.

BRIEF DESCRIPTION OF THE DRAWINGS

For a detailed description of preferred embodiments of the invention, reference will now be made to the accompanying drawings wherein.

DETAILED DESCRIPTION OF PREFERRED EMBODIMENTS

Figure 1:
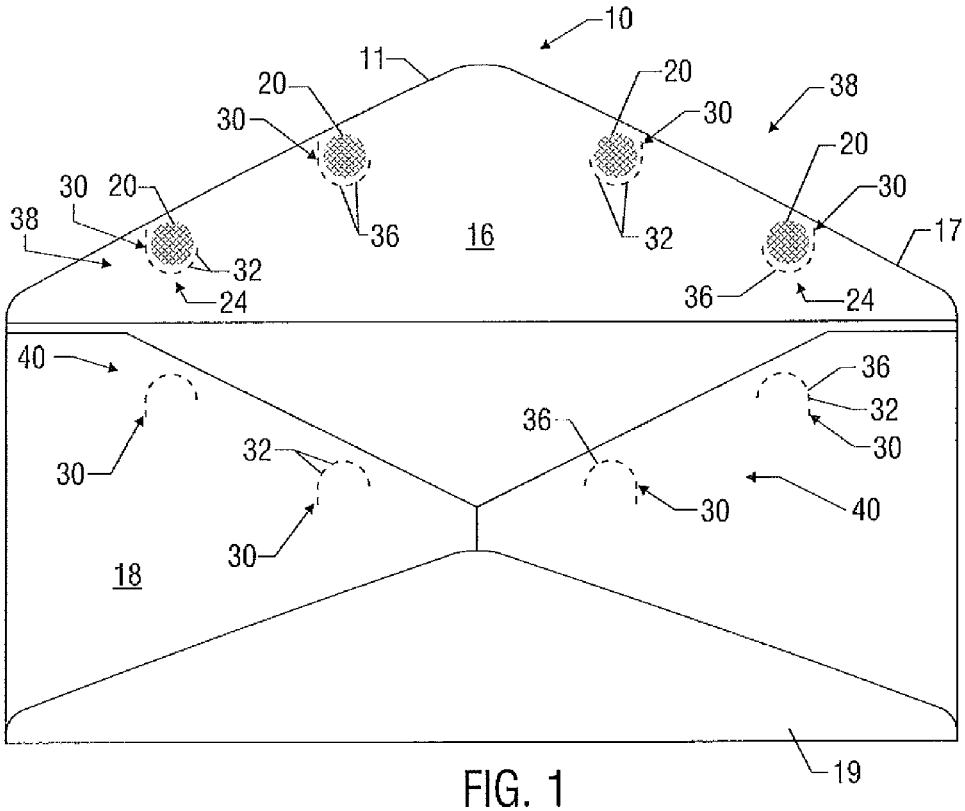
FIG. 1 is a front view of an example envelope-type container having a seal flap and facing panel and including an embodiment of the present disclosure having multiple adhesive spots and weakened areas.

Presently preferred embodiments of the invention are shown in the above-identified figures and described in detail below. It should be understood that the appended drawings and description herein are of preferred embodiments and are not intended to limit the invention or the appended claims. On the contrary, the intention is to cover all modifications, equivalents, and alternatives falling within the spirit and scope of the invention as defined by the appended claims. In showing and describing the preferred embodiments, common or similar features are indicated by like or identical reference numerals or, in the absence of a reference numeral, are evident based upon the appended drawings and/or description herein. The figures are not necessarily to scale and certain features and certain views of the figures may be shown exaggerated in scale or in schematic in the interest of clarity and conciseness.

As used in this patent (including the headings) of this patent, the terms "invention", "present invention" and variations thereof are not intended to mean the invention of every possible embodiment of the invention or any particular patent claim or claims. Thus, the subject or topic of each such reference is not necessarily part of every embodiment of the invention or required by any particular claim(s) merely because of such reference.

Figure 2:
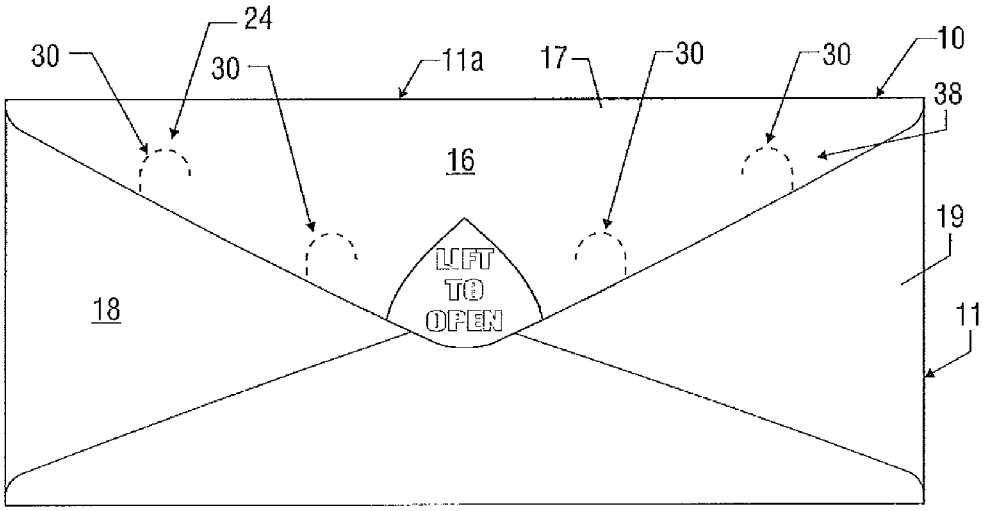
FIG. 2 shows the container shown in FIG. 1 having its seal flap and facing panel engaged together.

Referring initially to the embodiment of FIGS. 1-2, at least one adhesive spot 20 and at least one weakened area 30 are shown included on a container 10. The use of terms herein (such as "adhesive spot", "weakened area", etc.) in the singular grammatical form means "one or more" unless specifically indicated otherwise. In the illustrated example, the adhesive spot 20 and weakened area 30 are used in connection with the fastening and subsequent separation or release of first and second portions 16, 18 of the container 10. It should be noted that the adhesive spot 20 and/or weakened area 30 may be used in connection with the fastening and subsequent release of any two or more portions of the same container or multiple containers.

In accordance with one independent aspect of the embodiment of FIG. 1, the adhesive spot 20 is used to adhere the subject container portions together to attach or connect them, or to seal, close, enclose, fasten or secure the container, a part of the container or multiple containers. It should be understood that the present invention is in no way limited by the purpose for the connection or fastening, or the nature of the container(s) or connected container portions or the item or area that is enclosed. In the embodiment shown, the adhesive spot 20 does not span the entire length or width of the container portion upon which it is disposed, but may have any desired size. In some applications, the adhesive spot 20 may be formed of a minimal or particular size, such as to provide sufficient bonding and tension to connect the subject container portions, while having a desirable release factor to enable controlled separation thereof. Further, as desired, the adhesive spot 20 may or may not be used in addition to one or more other mechanism for adhering or connecting the subject container portions.

The adhesive spot 20 may be any desired, suitable mechanism for adhering the desired container portions together. For some examples, the adhesive spots 20 may be constructed of glue, tape, adhesive, remoistenable gum or glue, contact gum or glue, latex gum, peel-n-seal tape, two-sided taps, fugitive adhesive and any combination thereof. Thus, as used in this patent, the term "adhesive spot" means any suitable mechanism disposed upon at least one container portion for adhering two or more container portions together.

The adhesive spot 20 may have any suitable shape, size and orientation. Also, if desired, the type, quantity and thickness of the adhesive spot 20 may be selected, such as to provide sufficient bonding and tension while having a desirable release factor to enable controlled separation of the connected container portions. In the embodiment of FIG. 1, for example, each adhesive spot 20 is constructed of mailing glue formed in a generally circular shape with a standard thickness for use on paper envelopes. Some examples of other possible shapes of adhesive spots 20 are shown in FIGS. 3A-C, 4A-B. In yet other examples, the adhesive spot 20 may be elongated in any direction (not shown). Further, when multiple adhesive spots 20 are included, the spots 20 may differ in any desired manner, such as in shape, size, orientation and/or thickness.

In another independent aspect of the embodiment of FIG. 1, the illustrated weakened area 30 assists in at least one among (i) easing the separation or release of the connected container portions, (ii) reducing damage to, tearing or detachment of, one or more of the connected container portions during separation, (iii) preventing destruction of printed matter and/or graphics on the container. As used in this patent, the terms "separation control", "easing the separation" and variations thereof means having one or more of the capabilities of (i)-(iii) above. Some examples of separation control (easing the separation) are limiting the tearing, adhesion, peeling or ply separation of at least one of the connected container portions during separation regardless of the direction of separation of the connected container portions, controlling the separation or tearing of the connected container portions without the detachment of the associated adhesive spot from its original container portion and controlling damage to the connected container portions when separated in a particular direction. If desired, one or more feature of the present disclosure may be used in certain applications to provide evidence of separation, tampering or entry.

In the example of FIG. 1, the container 10 is an envelope 11, the first portion 16 is an envelope seal flap 17 and the second portion 18 is an envelope panel 19 that faces the seal flap 17 when engaged therewith. However, the container may be virtually any item or items of any nature having at least two portions that are desired to be fastened or connected together and/or separated or disconnected. Some other examples of containers include carriers, boxes, folded forms, welded forms, greeting cards, packaging, cartons, mailers, pockets, brochures, booklets, magazines, books, as well as re-usable cartons, boxes, forms, packaging, mailers and envelopes. Moreover, one or more feature of the present disclosure may be used to connect and disconnect two or more containers. Accordingly, as used in this patent, the term "container" means any single item having two portions that are desired to be fastened or connected and separated or disconnected, or two or more items that are desired to be connected and disconnected. Further, in any application of one or more feature of the present disclosure, the removable and/or non-removable container portions may include any desired printed matter, such as advertisements or coupons (not shown).

With respect to the use of the features of the present disclosure with envelopes, any desired type or configuration of envelope may be used. Some example types of envelopes are billing, proxy, direct mail, correspondence, storage and filing envelopes and overnight carriers. The envelopes may, for example, be constructed with a closure seal flap, a front panel and a back panel, and manufactured with or without in-side seam flaps, out-side seam flaps, diagonal seams, V-Flap seams, welded side-seams, multiple part snap-out seams, continuous form welded seams, or any combination thereof, or other suitable configuration. The envelopes may or may not include any desired type of window(s). Existing or conventional envelopes can be retrofitted with one or more feature of the present disclosure, or the feature(s) of the present disclosure can be used with new or modified envelope designs. When used with envelopes, the features of the present disclosure are in no way limited by the type or characteristics of the envelope.

Any suitable number of adhesive spots 20 and weakened areas 30 may be used. In the example of FIG. 1, multiple adhesive spots 20 and weakened areas 30 are included. A first group 38 of weakened areas 30 is formed into the envelope seal flap 17 adjacent to a set of adhesive spots 20. A weakened area 30 located adjacent to an adhesive spot 20 on the same container portion is sometimes referred to in this patent as an "adjacent" weakened area. In some applications, such as in FIG. 1, it may be desirable to have an adjacent weakened area 30 as close as feasible (e.g. in consideration of any pertinent production tolerances/limitations) to an adhesive spot 20 to optimize separation control.

The example of FIG. 1 also includes a second group 40 of weakened areas 30 formed into the panel 19, which does not have any adhesive spots 20. A weakened area 30 not adjacent to an adhesive spot 20 on the same container portion is sometimes referred to in this patent as an "opposing" weakened area. Each weakened area 30 of the second group 40 of this example has the same configuration and shape as the first group 38 of weakened areas 30. When the first and second portions 16, 18 are connected, the first group 38 of weakened areas 30 aligns with and overlays the second group 40. It should be understood, however, that the present disclosure does not require the inclusion of both adjacent and opposing weakened areas 30. Some embodiments include only adjacent weakened areas 30, while others include only opposing weakened areas 30. Further, when both types of weakened areas 30 are included, there need not be one opposing weakened area for each adjacent weakened area and vice versa, and the adjacent and opposing weakened areas 30 need not have the same configuration, shape and orientation.

In accordance with another independent aspect of the embodiment of FIG. 1, the weakened area 30 includes at least one cut 32 formed into the container 10. As used in this patent, the term "cut" means one or more score, perforation, hole, indentation, thin section or any other formation that is weaker than other areas of the container portion upon which it is included, or any combination thereof. In the example of FIG. 1, each illustrated cut 32 is a perforation extending through the respective envelope seal flap 17 or panel 19.

Still referring to the example of FIG. 1, when more than one cut 32 is included in a weakened area 30, a connector or gap 36 extends between adjacent cuts 32. In the embodiment shown, the connector 36 is a space between adjacent cuts 32 where the container portion is generally unaltered. In other embodiments, the connector 36 may include any desired alteration to the container portion.

The cuts 32 and connectors 36 (when included) may have any desired shape, size and orientation. For example, the shape and size of the cuts and connectors may be selected based upon the material composition, thickness of the container and/or the desired separation control and sturdiness (as defined below). In some applications, such as the example of FIG. 1, the cuts 32 assist in limiting or stopping tearing of or damage to one or more connected container portion during separation, thus enhancing release of the container portions and separation control. The exemplary illustrated connectors 36 of FIG. 1 provide support and "sturdiness" to the weakened area 30 during handling of the container and/or during separation. Sturdiness may be desirable for any suitable reason, such as to prevent inadvertent or undesirable breaking of the cuts 32 prior to separation of the connected container portions, and/or to withstand separating tension and prevent undesired detachment of the corresponding adhesive spot 20 and attached material from its original container portion during separation. The connectors 36 may instead or also serve as potential paths ("tear paths") for undesirable tearing and damage to one or more of the connected container portion(s) during separation thereof. In some embodiments, the longer the cut(s) 32, the greater the separation control and the less sturdy the weakened area 30, while the longer the connectors 36, the less the separation control and greater the sturdiness. Thus, it may be desirable or necessary to consider various factors in determining the nature and configuration of the weakened area 30 in any particular application.

Figure 3A:
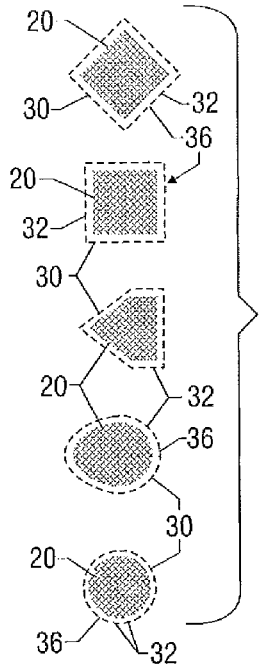
FIGS. 3A-3C are isolated views of various embodiments of adhesive spots with weakened areas having short cuts in accordance with the present disclosure.
Figure 4A:
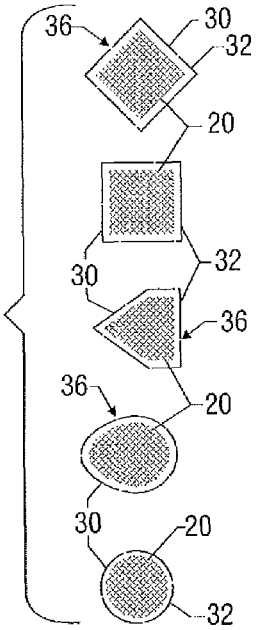
FIGS. 4A-B are isolated views of various embodiments of adhesive spots with weakened areas having long cuts in accordance with the present disclosure.
Figure 3B:
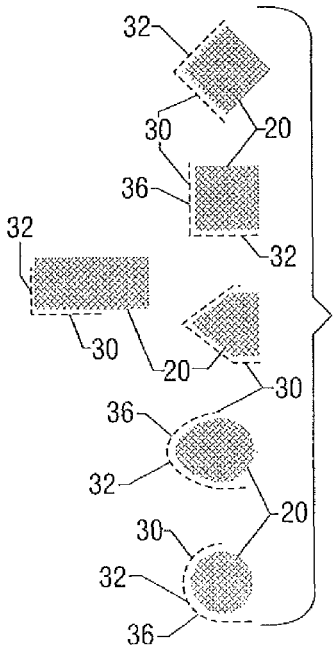
Figure 3C:
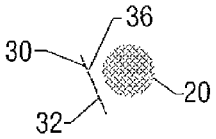
Figure 4B:
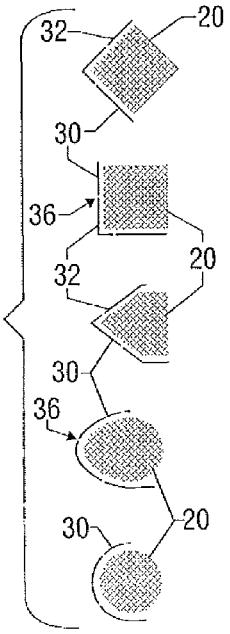

In the embodiments of FIGS. 3A-C, the weakened areas 30 each include a large number of short perforation-type cuts 32 and short connectors 36. In the examples of FIGS. 4A-B, the weakened areas 30 each include a small number of long cuts 32 and only a few short connectors 36. While the weakened areas 30 of FIGS. 4A-B may provide greater separation control in some applications as compared to the weakened areas 30 of FIGS. 3A-C, they may also be less sturdy.

In another independent aspect of the disclosure, the cut(s) 32 and connectors 36 (when included) of each weakened area 30 may be formed in any desired pattern, configuration and location. In FIG. 1, each adjacent weakened area 30 includes a single line of multiple short cuts 32 and corresponding short connectors 36 formed in a generally arcuate pattern adjacent to and around part of the perimeter of the corresponding adhesive spot 20. Some other example configurations of cuts 32 and connectors 36 forming weakened areas 30 are shown in FIGS. 3A-C and 4A-B.

In other embodiments, such as the examples of FIGS. 5A-F, the weakened area(s) 30 may include one or more overlapping cut 34. An overlapping cut 34 is a cut 32 that at least partially overlaps at least one other cut 32 (which may also be an overlapping cut 34) of the weakened area 30 without crossing such other cut(s) 32. As used in this patent, the term "overlap" and variations thereof means to be in front of or behind relative to an adhesive spot, or adjacent to, such as parallel, and not crossing. The use of overlapping cuts 34 in the weakened area 30 may, in some embodiments, improve or provide desired separation control and sturdiness. For example, in the embodiment of FIG. 5F, the weakened area 30 can be configured so that at least some of the connectors 36*a* are not facing, or are sideways relative to, the adhesive spot 20, while other connectors 36*b* are blocked by the overlapping cuts 34, lessening the likelihood of the connectors 36 serving as actual tear paths during separation. In such instance, the overlapping cuts 34 convolute the tear paths formed by the connectors 36. However, the present disclosure does not require either non-facing connectors 36*a* and/or blocked connectors 36*b* for all weakened areas 30 with overlapping cuts 34.

Any desired number of overlapping cuts 34 may be included in any desired configuration. Further, the overlapping cuts 34 may have any desired shape. For example, FIGS. 5A-F show various embodiments of arcuate-shaped cuts 32*a*, linear cuts 32*b* and combination arc/linear cuts 32*c*. Further, the weakened area 30 may include all of the same type of overlapping cut 34 or any combination of different types of overlapping and/or non-overlapping cuts.

Figures 5A, 5B, 5C, 5D, 5E, 5F:
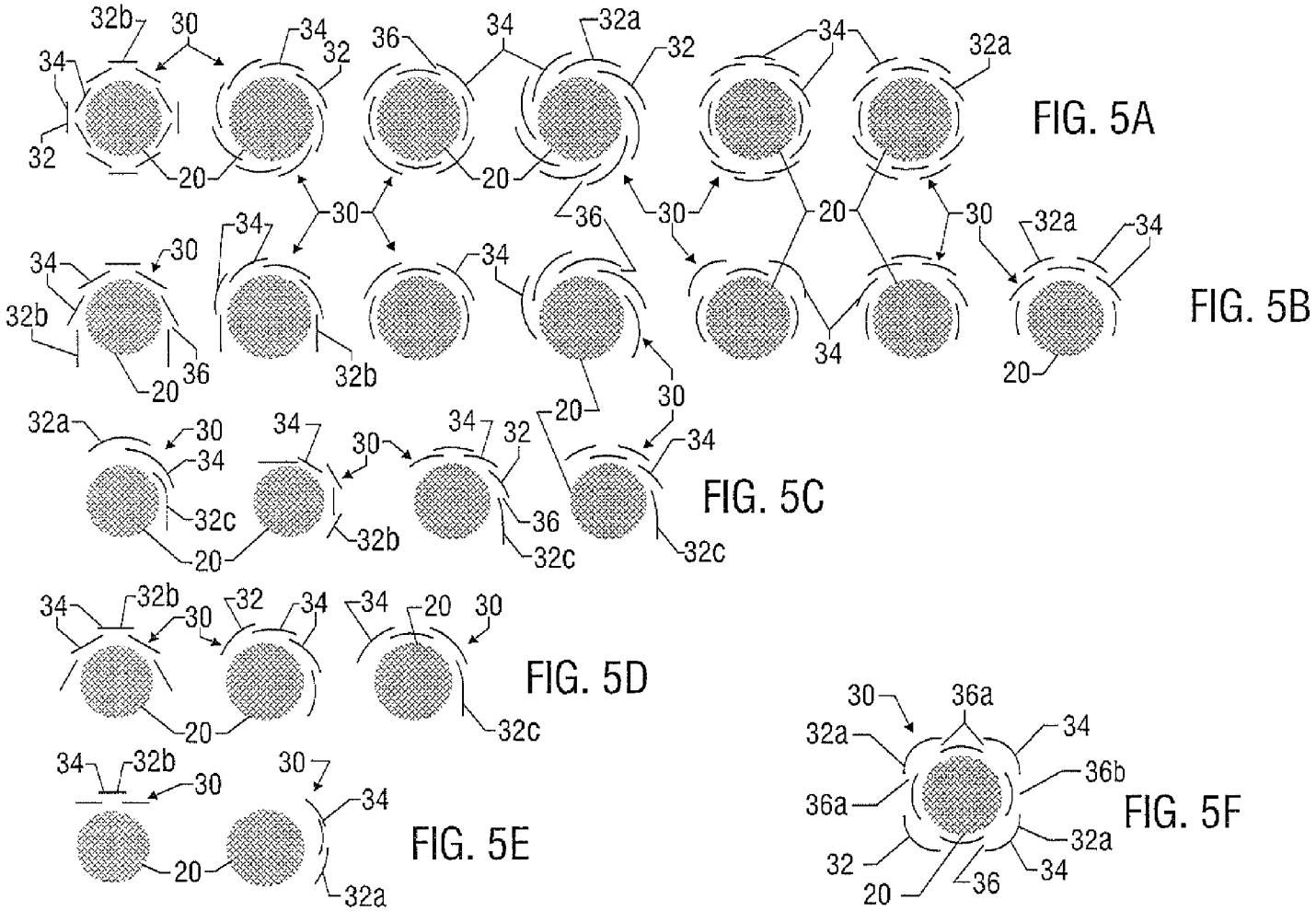
FIGS. 5A-F are isolated views of various embodiments of adhesive spots with weakened areas having overlapping cuts in accordance with the present disclosure.

The overlapping cuts 34, when included, may have any desired length. In some applications, long cuts 34 and/or long connectors 36 may provide sufficient sturdiness and still provide desired separation control. In the embodiment of FIG. 5F, for example, the weakened area 30 includes large overlapping cuts 34 and large connectors 36. Because the overlapping cuts 34 cumulatively entirely surround the perimeter of the adhesive spot 20, the weakened area 30 should be expected (in various applications) to terminate virtually all container portion tearing and damage around the corresponding adhesive spot 20 during normal separation. At the same time, the connectors 36 should provide suitable sturdiness to withstand separating tension and prevent substantial, or in some cases any, detachment of material from either or both container portions proximate to the corresponding adhesive spot.

In still a further independent aspect of various embodiments of the present disclosure, the cuts 32 and connectors 36 of a weakened area 30 may be disposed in any desired orientation relative to one or more adhesive spot 20. FIGS. 3A-5F show a multitude of different example orientations. In the embodiments of FIGS. 3C and 5E, the cuts 32 are located generally adjacent to one side of the adhesive spot 20. In the embodiments of FIG. 5C, the cuts 32 are located generally adjacent to two sides of the adhesive spot 20. In the embodiments of FIG. 5B, the cuts 32 are located generally adjacent to three sides of the adhesive spot 20. In the embodiment of FIGS. 3A, 4A, 5A and 5F, the cuts 32 generally surround the adhesive spot 20. In many applications, a weakened area 30 having surrounding cuts 32, such as the embodiments of FIG. 5A with its overlapping cuts 34, may be designed to provide optimal separation control and optimal sturdiness by preventing undesired tearing, while withstanding separating tension to avoid adhesive spot detachment. In other applications, a weakened area 30 with surrounding cuts 32, such as shown in FIG. 4A, may be designed to provide for detachment of part of the connected container portion originally having the adhesive spot (see e.g. FIG. 17B).

The orientation or positioning of the cuts 32 forming a weakened area 30 may, if desired, be selected based upon the expected or proscribed direction(s) of separation of the connected container portions, or to provide separation control regardless of the direction of separation. For example, in the embodiment of FIGS. 1 and 2, the cuts 32 of the weakened areas 30 are located around the trailing side 24 of the adhesive spots 20. The trailing side 24 is the last side of the adhesive spot 20 to be disconnected during separation. In FIG. 2, the expected or proscribed direction of separation of the first and second portions 16, 18 is the lifting of the envelope seal flap 17 upwardly from the panel 19 and toward the top 11*a* of the envelope 11. If that occurs, each weakened area 30 will provide separation control relative to its corresponding adhesive spot 20.

For other examples, the cuts 32 of the embodiments of FIGS. 3C and 5E can be positioned on the expected trailing side of the corresponding adhesive spot 20. The cuts 32 of the embodiment of FIG. 5C will provide separation control when the connected container portions are separated generally in either of two directions. In the embodiments of FIG. 5B, the cuts 32 will provide separation control when the connected container portions are separated generally in any of three directions. For yet other examples, weakened areas 30 having cuts 32 that generally or substantially entirely surround an adhesive spot 20, such as in FIGS. 3A, 4A, 5A and 5E, may be included to provide separation control regardless of the proscribed direction of separation of the connected container portions.

Figure 6:
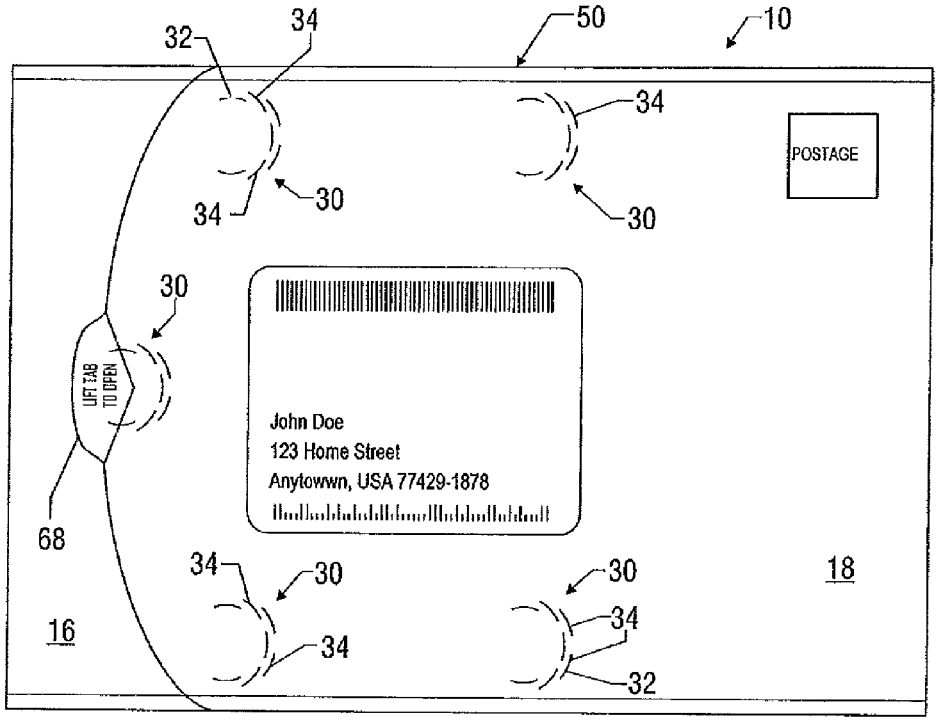
FIG. 6 is a front view of an example disc-holding container including an embodiment of the present disclosure having weakened areas with overlapping cuts.

Referring to the embodiment of FIG. 6, the present disclosure is shown used on an example DVD/CD mailer 50 having first and second portions 16, 18. A plurality of weakened areas 30 with overlapping cuts 34 is formed in the second portion 18 adjacent to numerous adhesive spots (not shown). The proscribed direction of separation of the first and second portions 16, 18 is from left to right and the cuts 34 of the weakened areas 30 encompass the trailing sides 24 of the adhesive spots 20.

Figure 7A:
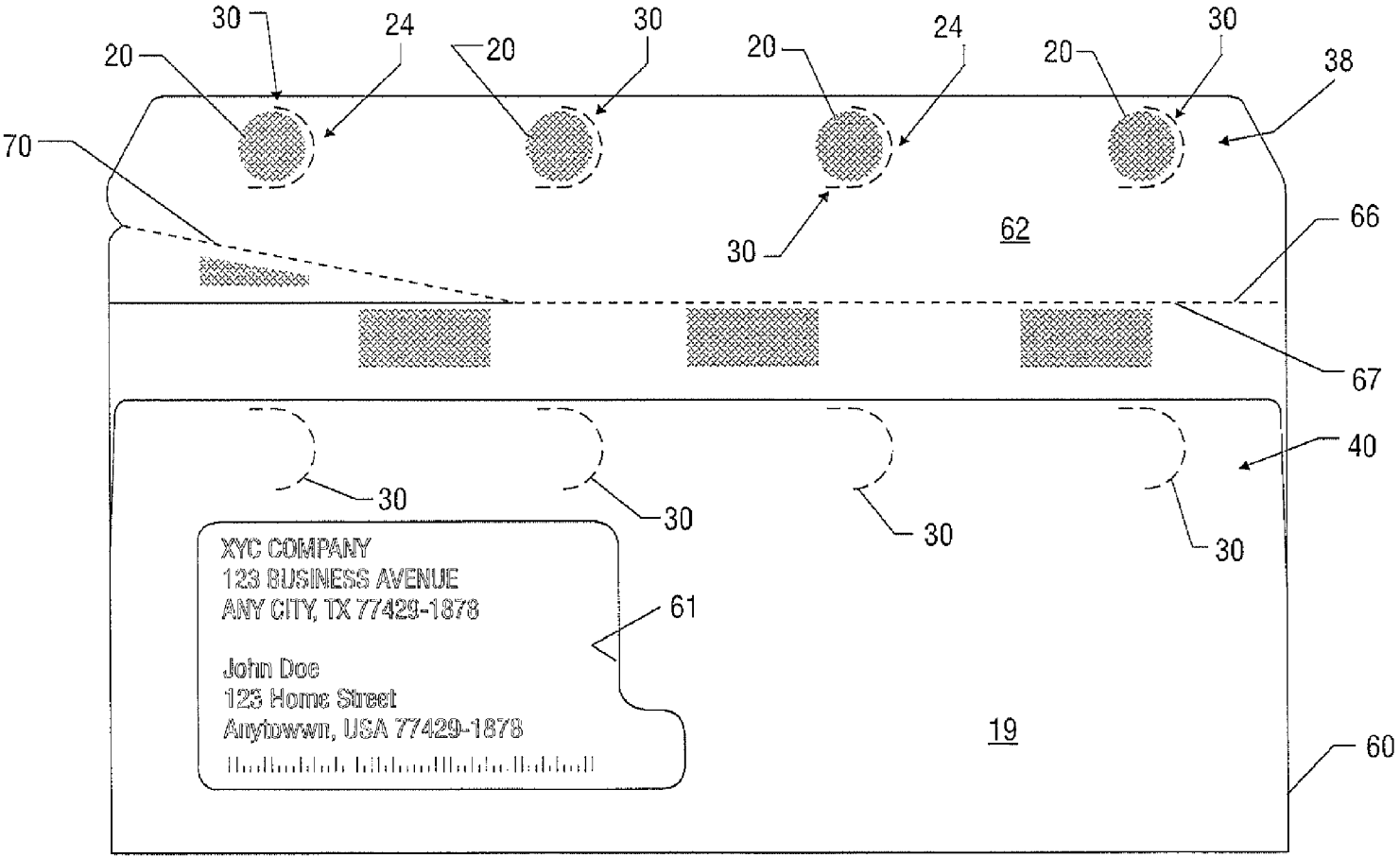
FIGS. 7A-C are front views of an example reusable envelope-type container including an embodiment of the present disclosure.
Figure 7B:
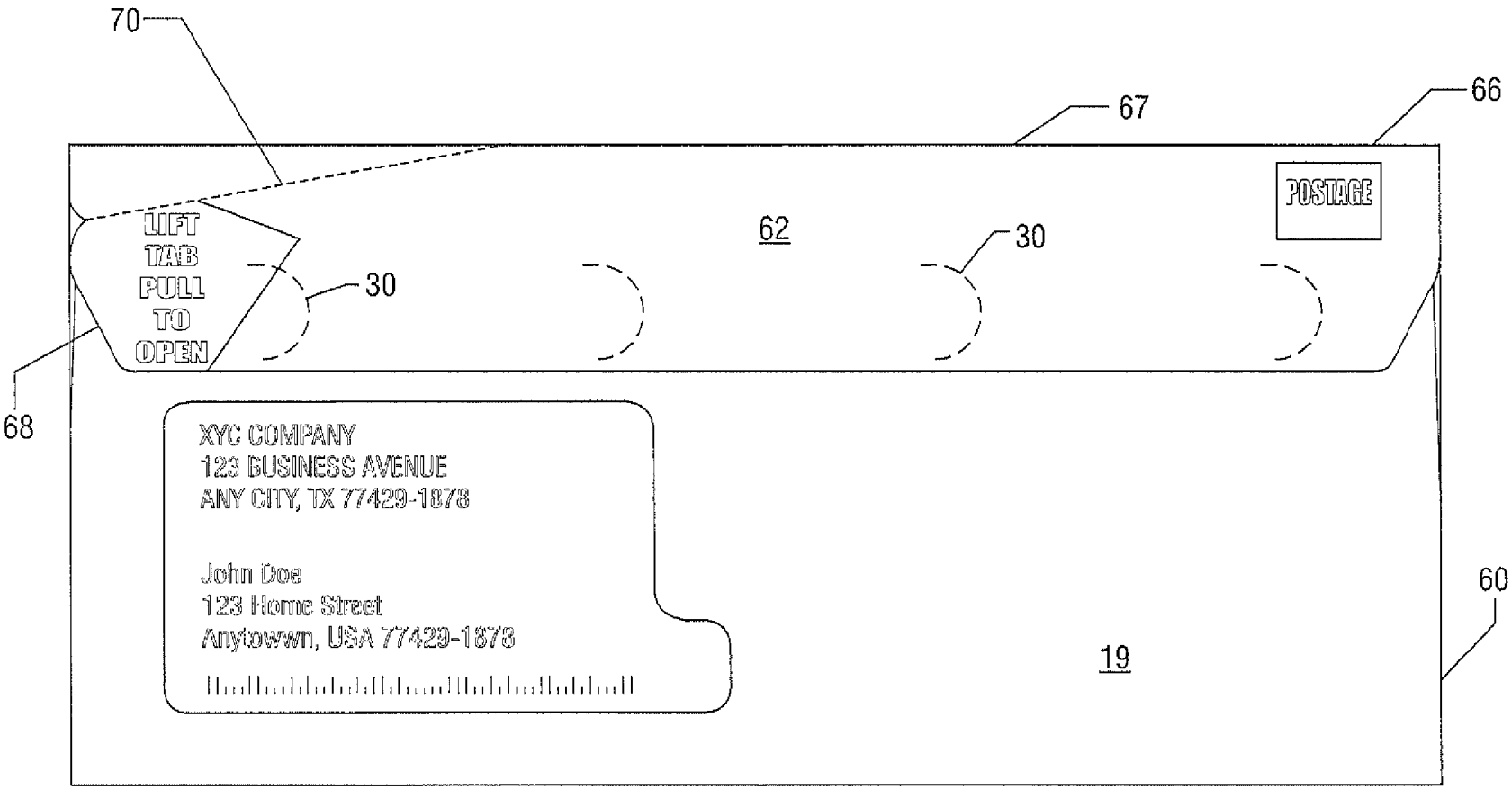
Figure 7C:
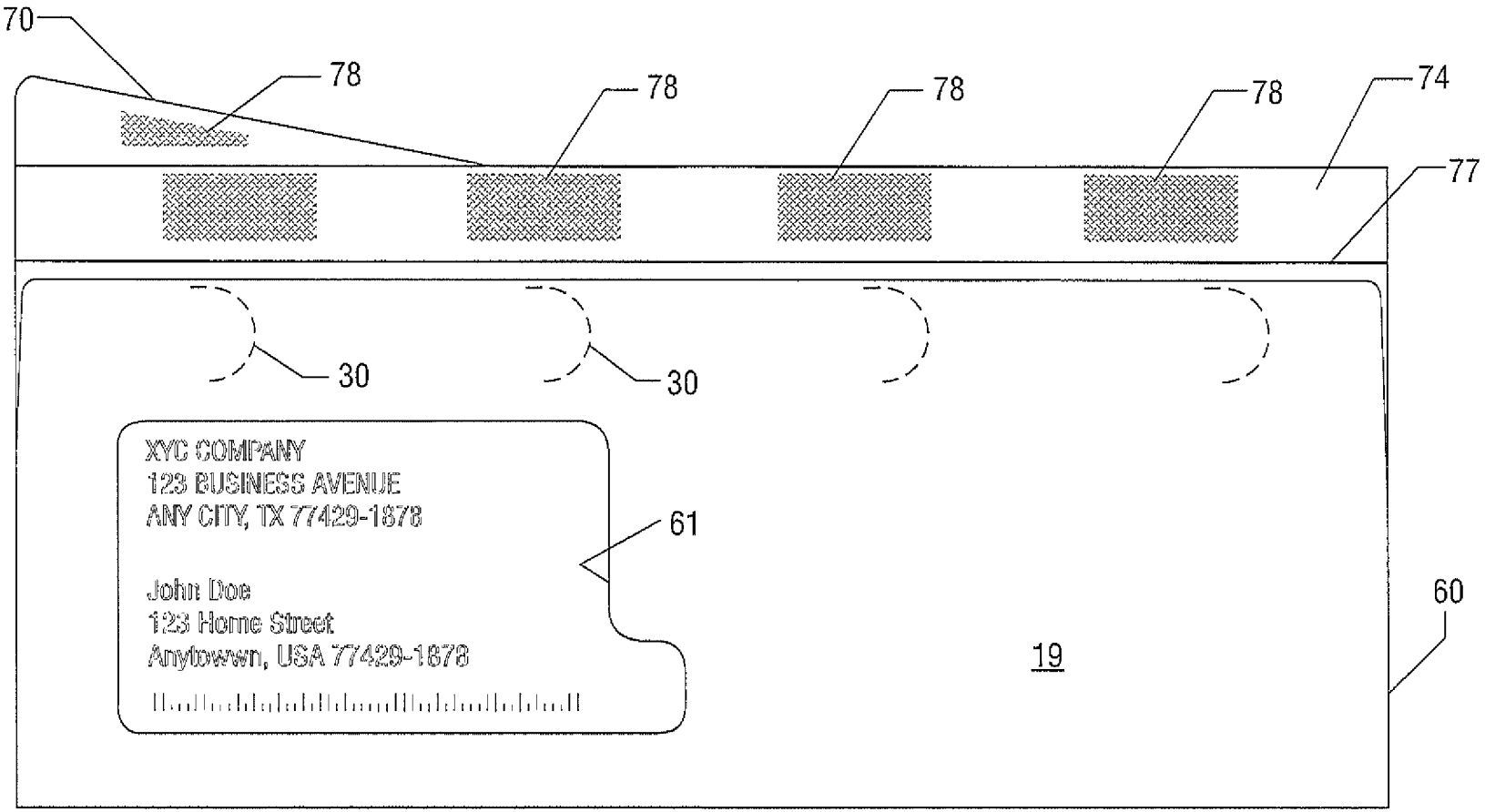
Figure 7D:
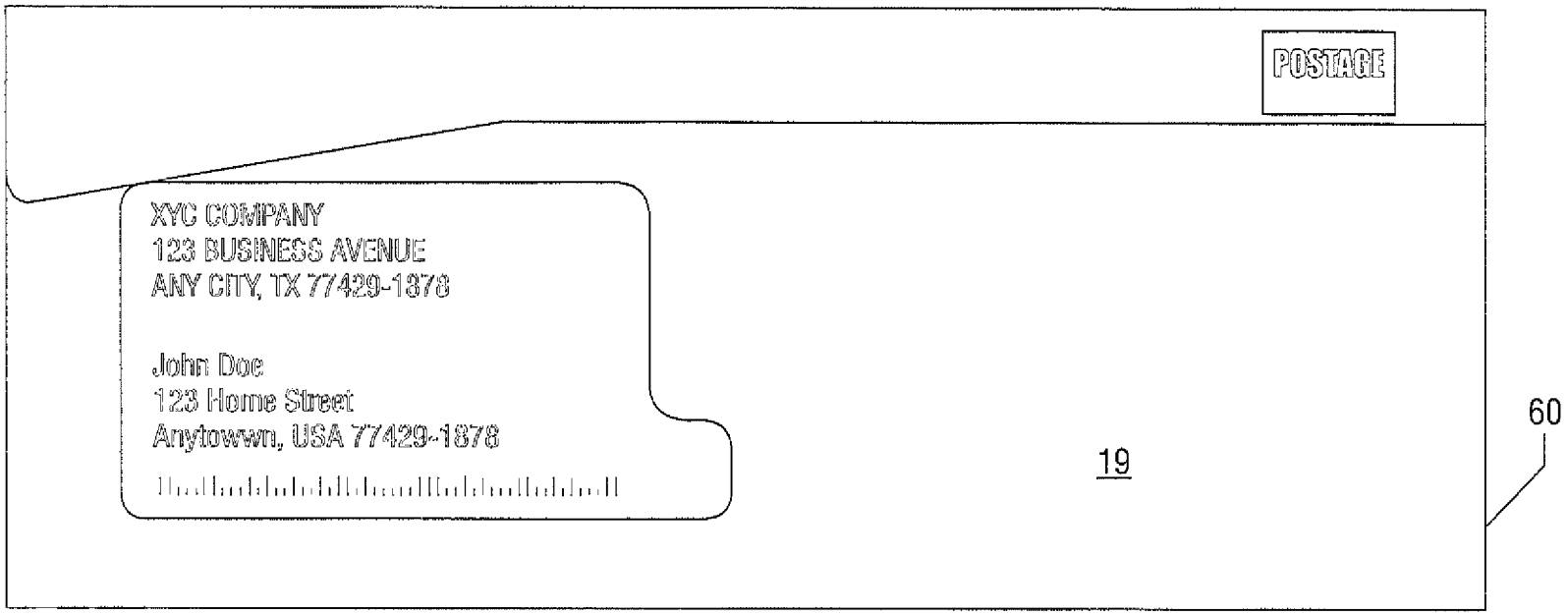

FIGS. 7A-D show an embodiment of the present disclosure used in connection with an example reusable envelope 60 having an address window 61. As shown in FIG. 7A, a first group 38 of weakened areas 30 and adjacent adhesive spots 20 is included on an initial seal flap 62. A second group 40 of weakened areas 30 is included on the panel 19. FIG. 7B shows the initial seal flap 62 folded down along top fold line 66 and engaged with the facing panel 19 by the adhesive spots 20. To open the envelope 60 and preserve it for reuse (e.g. resealing, remailing), the initial seal flap 62 is gripped and lifted, such as at a tab 68, and preferably pulled to the right. In this example, the initial seal flap 62 will separate from the envelope 60 along an angled perforation line 70 and a perforated part 67 of the top fold line 66. At substantially the same time, the first and second sets 38, 40 of weakened areas 30 provide separation control at the adhesive spots 20, allowing the initial seal flap 62 to be generally concurrently separated from the facing panel 19 and detached from the envelope 60. After the initial seal flap 62 is removed, as shown in FIG. 7C-D, a re-seal flap 74 may be folded along a second fold line 77 and engaged with the facing panel 19, such as by the adhesive areas 78, for reuse of the envelope 60.

Figure 8:
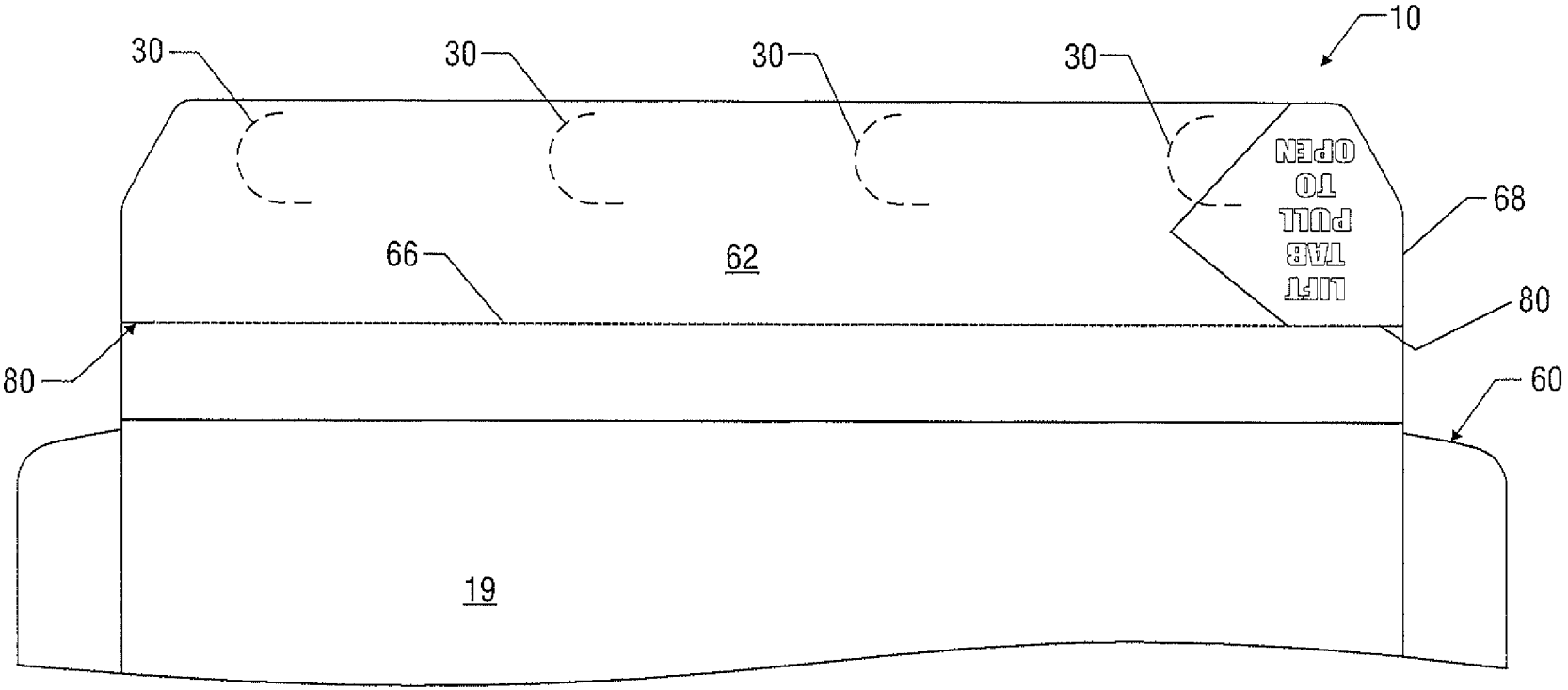
FIG. 8 is a partial rear view of an example envelope-type container including an embodiment of the present disclosure.

FIG. 8 shows another embodiment of the present disclosure in use with another example reusable envelope 60. In this example, to close or seal the envelope 60, an initial seal flap 62 is folded down along top fold line 66 and engaged to the insider surface (not shown) of a facing panel 19 by numerous adhesive spots (not shown). The top fold line 66 is perforated to enable removal of the initial seal flap 62 from the envelope 60. However, the top fold line 66 also includes at least one non-perforated section 80 to assist in preventing inadvertent, accidental or undesirable breaking of the perforated top fold line 66 during manufacture, assembly or handling of the envelope 60.

Figure 9:
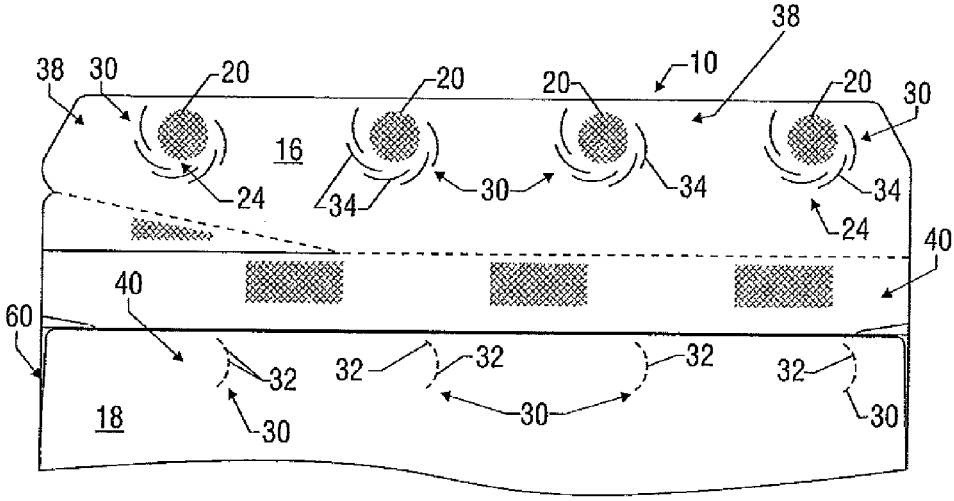
FIG. 9 is a partial front view of an example envelope-type container including an embodiment of the present disclosure.

In the embodiment of FIG. 9, the present disclosure is used on a reusable envelope 60 having first and second portions 16, 18. A group 38 of adjacent weakened areas 30 is included on the first portion 16, while a group 40 of opposing weakened areas 30 is included on the second portion 18. However, the adjacent and opposing weakened areas 30 have different configurations. The weakened areas 30 of the first group 38 include overlapping cuts 34 that generally surround three sides of the adjacent adhesive spots 20. The weakened areas 30 of the second group 40 have a single row of short cuts 32, which will lie adjacent to only one side of the adhesive spots 20 when the portions 16, 18 are connected.

Figure 10:
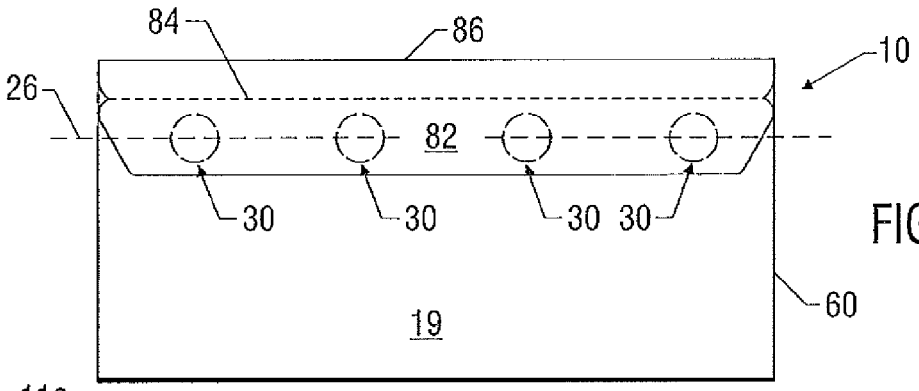
FIG. 10 is a front view of an example envelope-type container having a removable portion and including an embodiment of the present disclosure.

FIGS. 10-13 show various examples of envelopes in closed or sealed positions, and which include embodiments of the present disclosure. In FIG. 10, the envelope 60 includes a removable seal flap 82 engagable with a facing panel 19 by numerous adhesive spots (not shown) disposed along a common linear axis 26. The seal flap 82 is detachable from the envelope 60 along a perforation line 84 spaced from the top edge 86 of the envelope 60, and separable from the facing panel 19 by numerous weakened areas 30. Because the weakened areas 30 surround the corresponding adhesive spots (not shown), the seal flap 82 may be removed in any direction. Removal from left-to-right or right-to-left will allow the seal flap 82 to be generally concurrently detached from the envelope 60 and separated from the facing panel 19. Alternately, the seal flap 82 may be first separated from the facing panel 19 at the adhesive spots (such as by lifting upwardly and toward the top edge 86 of the envelope 60), and subsequently separated from the envelope 60 along the perforation line 84.

Figure 11:
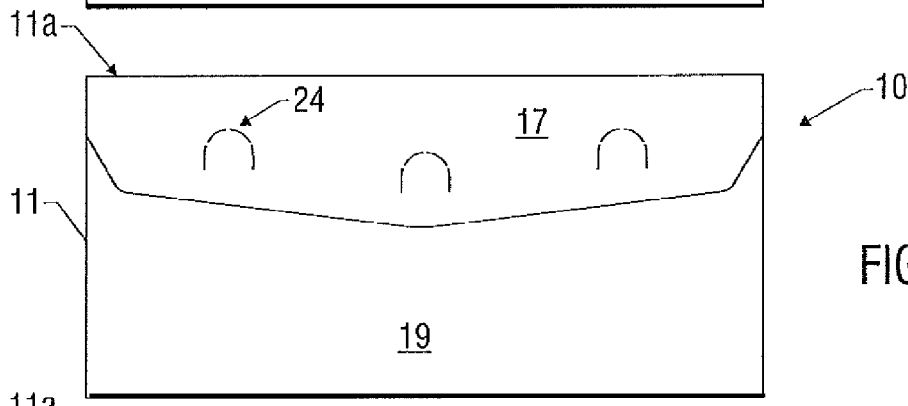
FIG. 11 is a front view of an example envelope-type container including an embodiment of the present disclosure.
Figure 12:
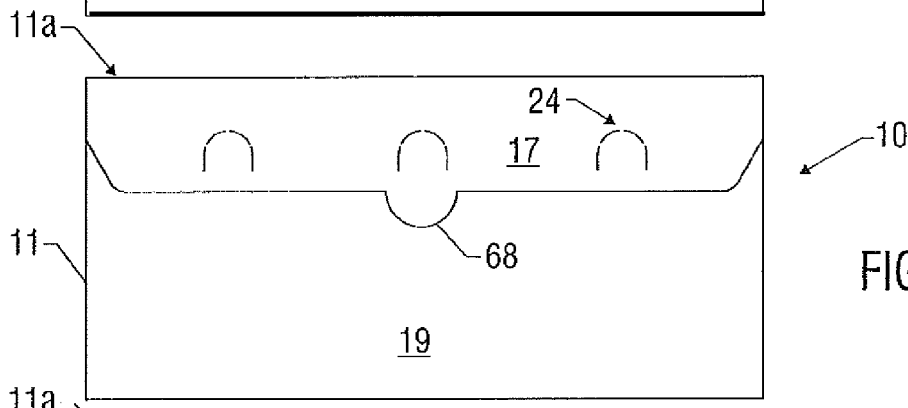
FIG. 12 is a front view of another example envelope-type container including an embodiment of the present disclosure.
Figure 13:
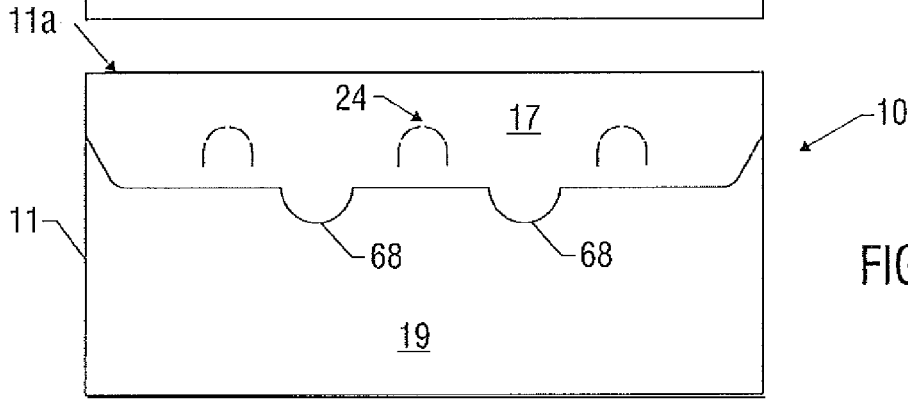
FIG. 13 is a front view of another example envelope-type container including an embodiment of the present disclosure.

In each of FIGS. 11-13, an envelope 11 includes numerous adhesive spots (not shown) on a seal flap 17 for connection to a facing panel 19. A weakened area 30 is located adjacent to each adhesive spot (not shown) to allow separation of the seal flap 17 from the facing panel 19 by lifting the seal flap 17 and pulling it upwardly toward the top 11*a* of the envelope 11. One or more pull tab 68 may be included to provide an easily grippable portion on the seal flap 17.

Figure 14A:
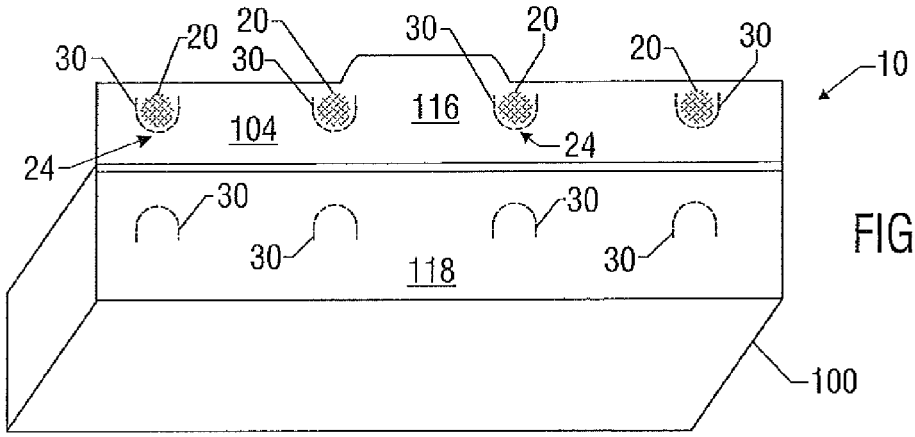
FIGS. 14A-B are partial top views of an example carton-type container including an embodiment of the present disclosure.
Figure 14B:
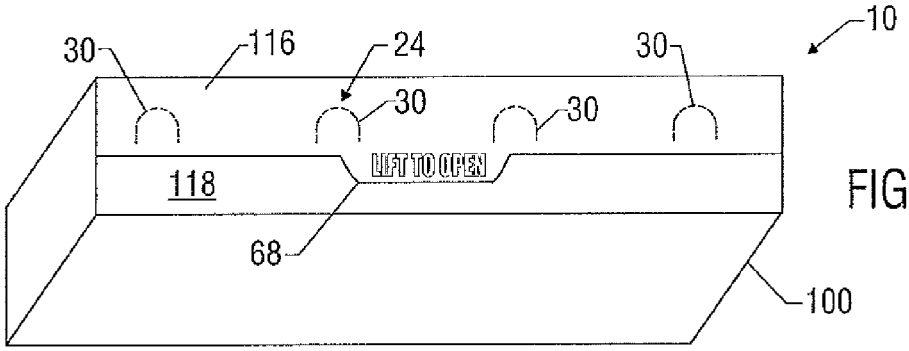

FIGS. 14A-B illustrate an example carton 100 having first and second panels 116, 118 useful for closing and opening the carton 100. In FIG. 14A, the first panel 116, shown in an open position, includes four adhesive spots 20 on its inner surface 104 and four adjacent weakened areas 30 in accordance with an embodiment of the present disclosure. The second panel 118 includes four opposing weakened areas 30. In FIG. 14B, the panels 116, 118 are shown in a closed position and fastened together by the adhesive spots 20, and the weakened areas 30 of the first panel 116 are aligned over the weakened areas (not shown) of the second panel 118. To open the carton 100 with separation control, the first panel 116 is preferably pulled upwardly and away from the second panel 118. In such instance, the weakened areas 30 are on the trailing side of the adhesive spots 20.

Figure 15A:
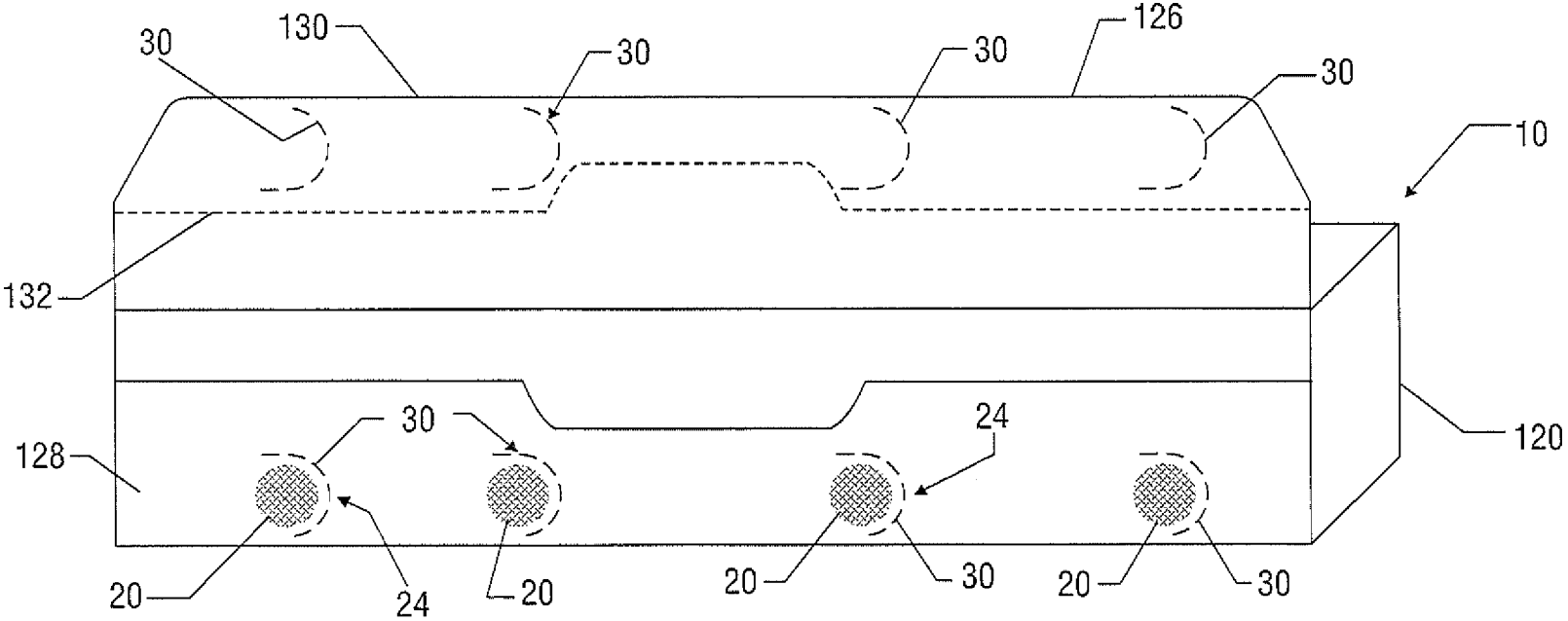
FIGS. 15A-E are partial top views of an example box-type container with a removable portion and including an embodiment of the present disclosure.
Figure 15B:
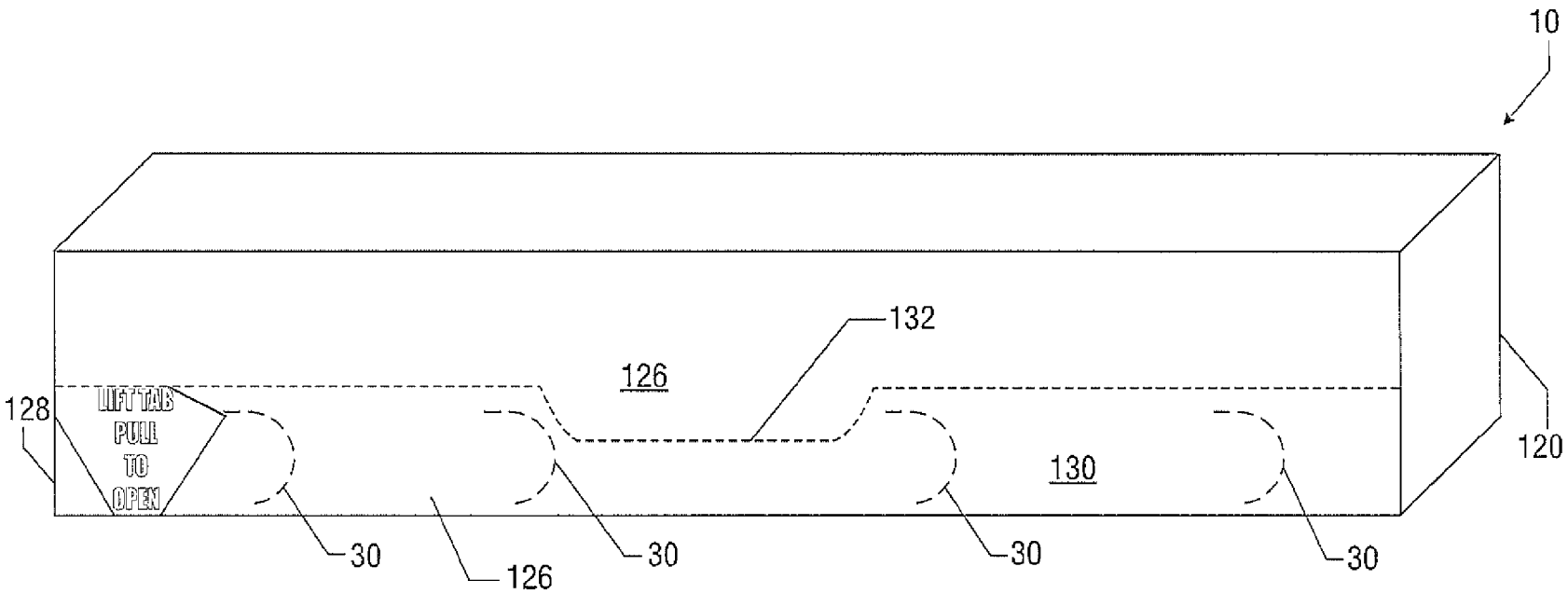
Figure 15C:
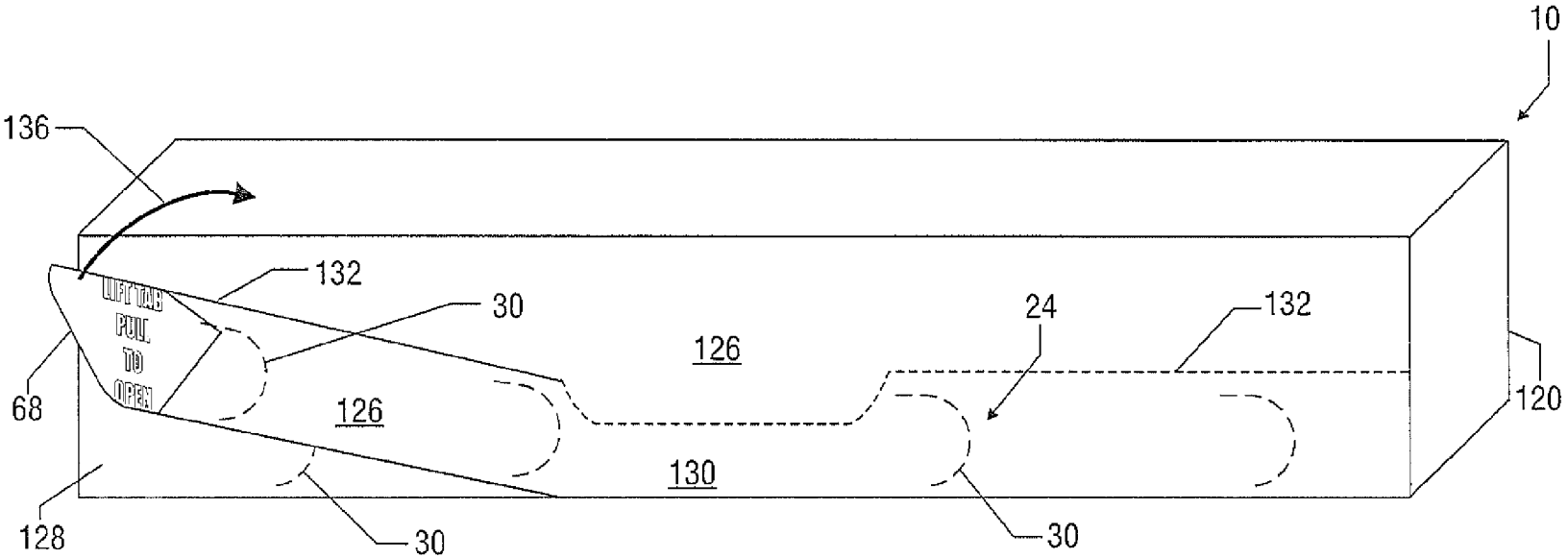
Figure 15D:
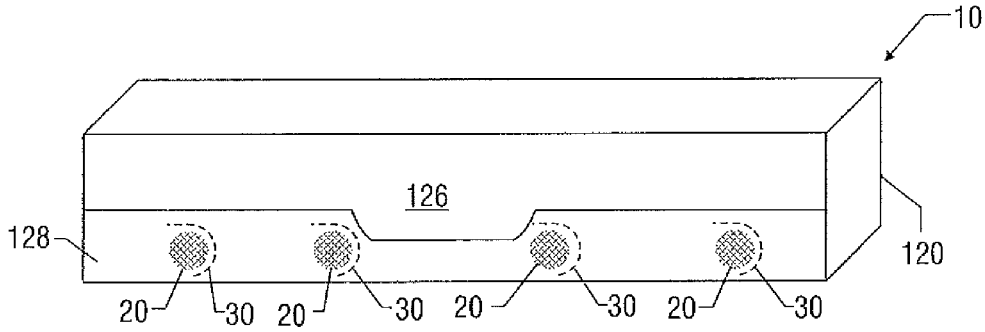
Figure 15E:
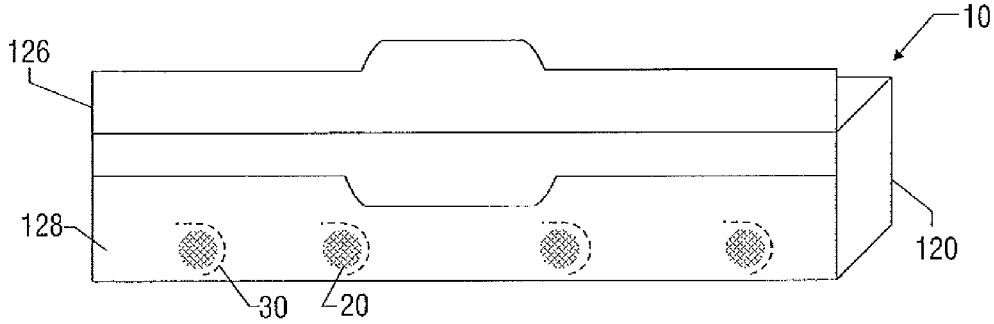

In the embodiments of FIGS. 15A-E, an example cardboard or paperboard box 120 is shown having first and second panels 126, 128 useful for closing and opening the box 120. As shown in FIG. 15A, a removable seal flap 130 having numerous opposing weakened areas 30 is connected to the first panel 126 along a perforated line 132. The second panel 128 includes numerous weakened areas 30 adjacent to numerous adhesive spots 20. In FIG. 15B, the first and second panels 126, 128 are secured together by the adhesive spots 20, and the box 120 is closed. In FIG. 15C, the seal flap 130 is shown being removed. By lifting and pulling the seal flap 130 from left to right in a single general motion, as generally indicated by arrow 136, the flap 130 is detached from the first panel 126 along the perforation line 132 and separated from the second panel 128 generally at the weakened areas 30. After the seal flap 130 is removed, as shown in FIGS. 150-E, the first and second panels 126, 128 can be re-used for opening and closing the box 120.

Figure 16A:
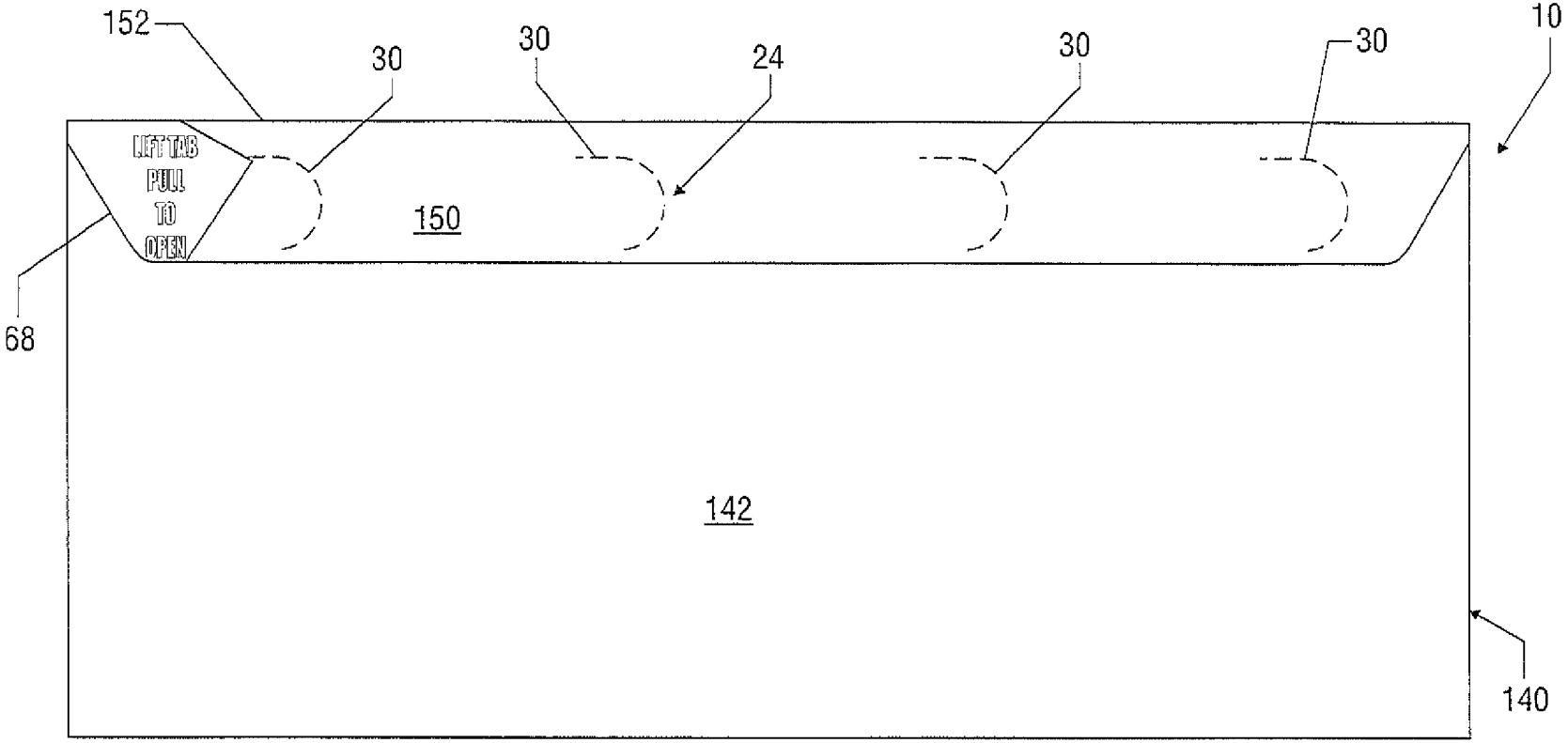
FIGS. 16A-C are front views an example form-type container with a removable portion and including an embodiment of the present disclosure.
Figure 16B:
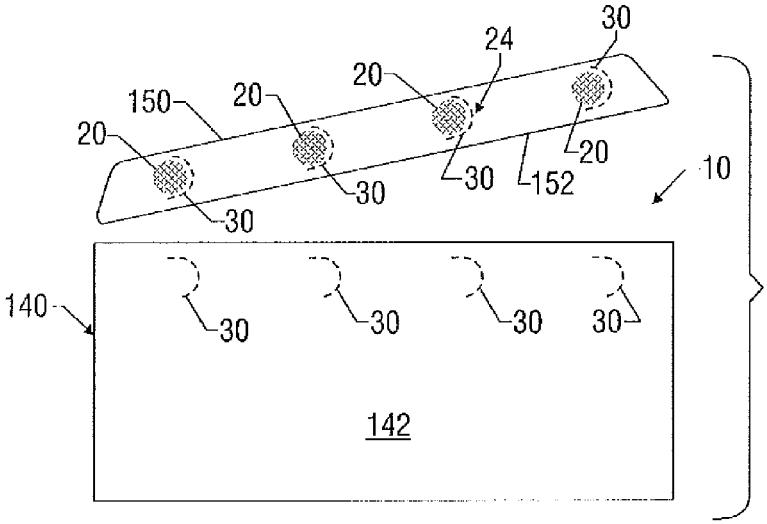
Figure 16C:
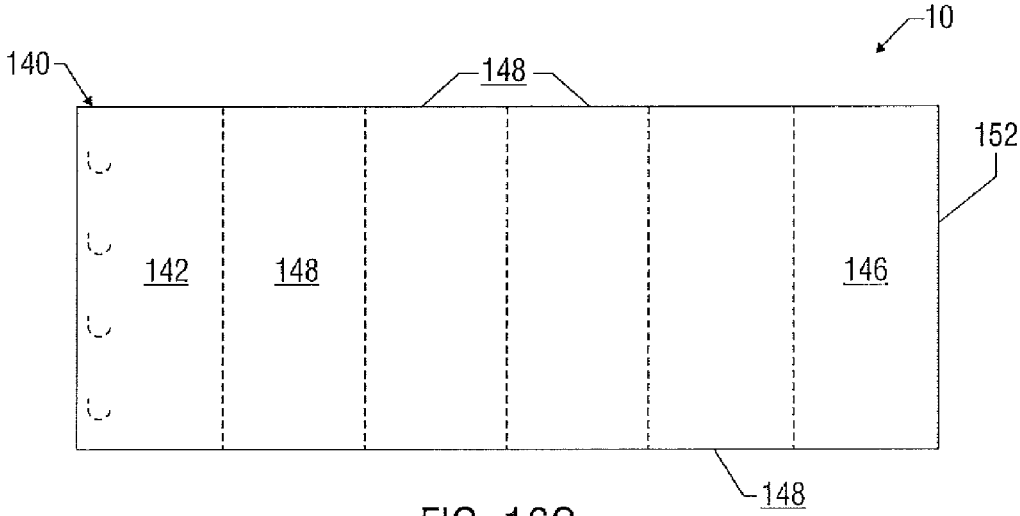

FIGS. 16A-C show an embodiment of the present disclosure used in connection with an example form 140. The form 140 has front and back panels 142, 146 and numerous interior panels 148 (FIG. 16C) disposed therebetween in an accordion, or foldable, configuration. A removable closure flap 150 is connected to the back panel 146 by a perforation line 152 and includes numerous adhesive spots 20 and aligned weakened areas 30. The front panel 142 includes numerous opposing weakened areas 30.

In FIG. 16A, the closure flap 150 is engaged with the front panel 142 by the adhesive spots 20, thus connecting the front and back panels. The orientation of the aligned and opposing weakened areas 30 provides for easy opening of the form 140 by pulling the closure flap 150 away from the front panel 142 from left to right. The closure flap 150 will detach from the back panel (not shown) along the perforation line 152 and from the front panel 142 proximate to the weakened areas 30. FIG. 16B shows the closure flap 150 removed from the form 140.

Figure 17A:
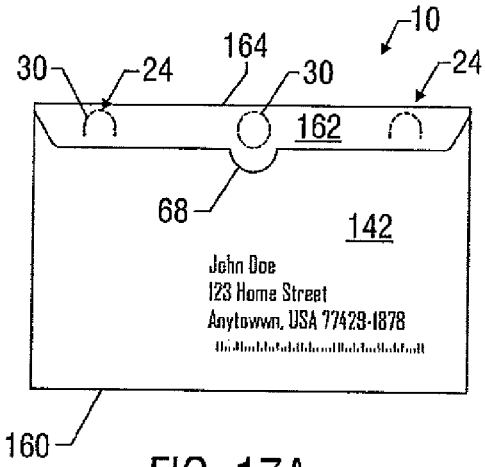
FIGS. 17A-C are front views an example brochure-type container including an embodiment of the present disclosure.
Figure 17B:
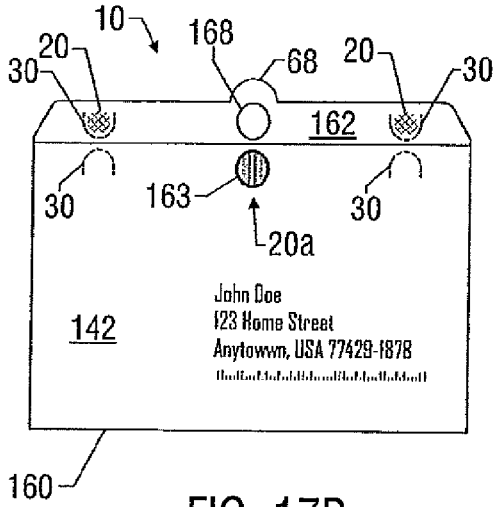
Figure 17C:
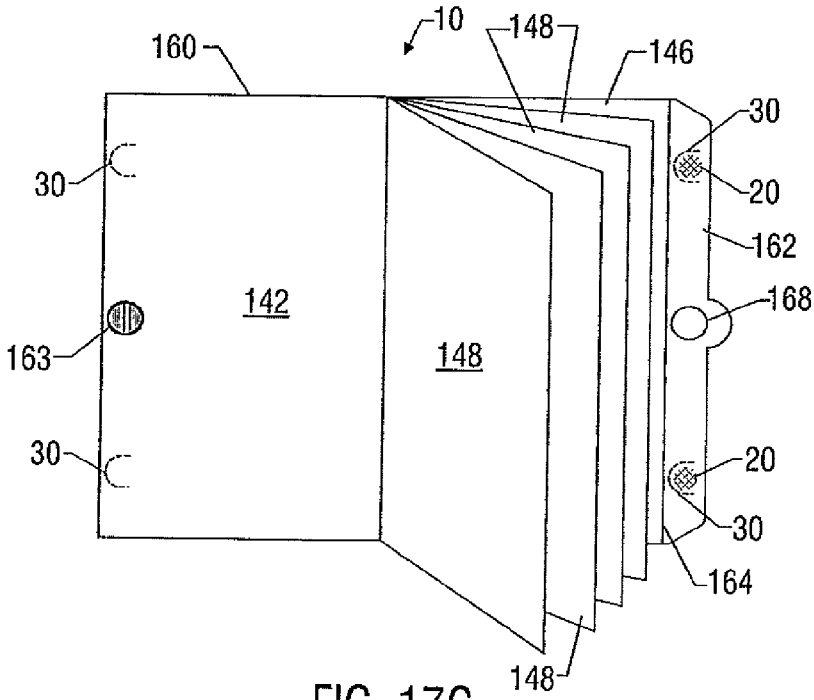

FIGS. 17A-C illustrate a mailable brochure 160 having front and back panels 142, 146 and numerous interior pages 148 disposed therebetween. A seal flap 162 extends from the back panel 146 at a fold line 164 and includes numerous adhesive spots 20 and aligned weakened areas 30. The front panel 142 includes numerous opposing weakened areas 30. In FIG. 17A, the front and back panels are connected, the seal flap 162 being engaged with the front panel 142 by the adhesive spots (not shown). The orientation of the illustrated aligned and opposing weakened areas 30 provides for easy opening of the brochure 160 by gripping the seal flap 162, such as at the tab 68, and pulling it away from the front panel 142 upwardly and in the direction of the fold line 164.

FIG. 17B shows the brochure 160 in an open position. If desired, the brochure 160 may be designed so that upon separation of the seal flap 162 and front panel 142, a portion 163 of the flap 162 tears off the flap 162 generally around the center adhesive spot 20*a*. The portion 163 of the flap 162 may remain attached to the front panel 142 (FIG. 17C) and a hole 168 left in the flap 162.

The embodiments of FIGS. 18A-18L provide various additional exemplary sizes, shapes and configurations of adhesive spots 20 and weakened areas 30 in accordance with the present disclosure.

Figure 18A:
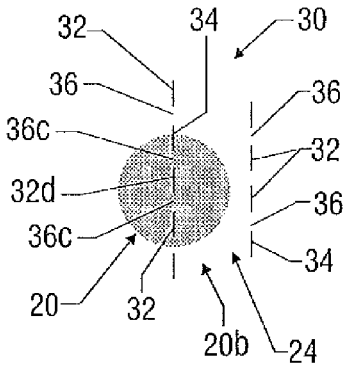
FIGS. 18A-L are isolated views of various embodiments of adhesive spots with weakened areas in accordance with the present disclosure.

Referring to the embodiment of FIG. 18A, if desired, the weakened area 30 may include cuts 32 extending through or at least partially across one or more adhesive spot 20, referred to herein sometimes as "integrated cuts" 32*d*. The weakened area 30 may also include connectors 36 ("integrated connectors" 36*c*) extending between adjacent integrated cuts 32*d*. FIGS. 18A, 18C, 18E-G, 181 and 18L provide various embodiments of weakened areas 30 having integrated cuts 32*d* and corresponding integrated connectors 36*c*.

Integrated cuts 32*d* may be included to assist in separation control, or any other desired purpose. For example, the integrated cuts 32*d* may be included to stop or break the connection formed by the adhesive spot 20 between attached container portions (not shown) at the vicinity of the integrated cuts 32*d*. Likewise, integrated connectors 36*c* may also be used to assist in separation control, or any other desired purpose. For example, the illustrated integrated connectors 36*c* allow the continued adhesion of the attached container portions (not shown) by the adhesive spot 30 between the integrated cuts 32*d*, so that together the integrated cuts 32*d* and integrated connectors 36*c* assist in easing the separation of the attached container portions. In the embodiment of FIG. 18A, the preferred direction of separation of the container portions (not shown) with which the illustrated adhesive spot 20 and weakened area 30 are used is from Left to Right. When the connected container portions (not shown) are pulled apart or separated at the adhesive spot 20, they will disconnect at the integrated cuts 32*d*, while remaining connected at the integrated connectors 36*c*. The back half 20*a* of the exemplary adhesive spot 20 thus remains only partially connected between the container portions along paths extending through the integrated connectors 36*c*. In such instance, less separation and possible tearing becomes necessary beyond the integrated cuts 32*d*, assisting in separation control and making separation easier.

Figure 18B:
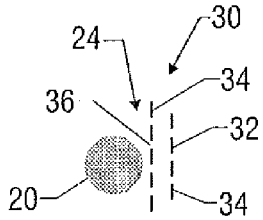

Referring still to the embodiment of FIG. 18A, when a weakened area 30 with integrated cuts 32*d* is used, it may also sometimes be desirable to include cuts 32 on the trailing side 24 of the adhesive spot 20 to assist in providing separation control, or for any other desired reason. In the embodiments of FIGS. 18A, 18B and 18G, the preferred direction of separation of the container portions (not shown) with which the illustrated adhesive spots 20 and weakened areas 30 are used is from Left to Right. Each illustrated weakened area 30 thus includes cuts 32 on the trailing side 24 of the respective adhesive spot 20.

Figure 18C:
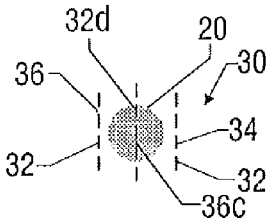
Figure 18D:
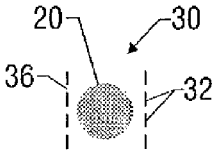
Figure 18E:
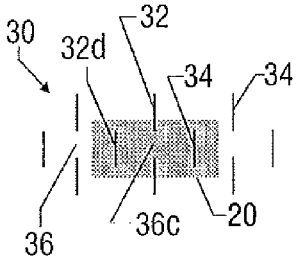
Figure 18F:
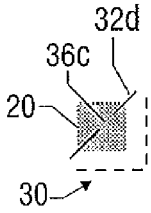
Figure 18G:
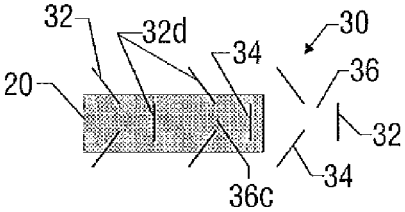
Figure 18H:
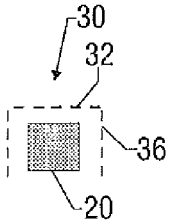
Figure 18I:
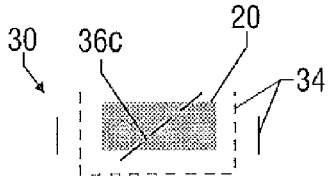
Figure 18J:
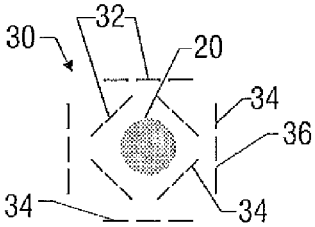
Figure 18K:
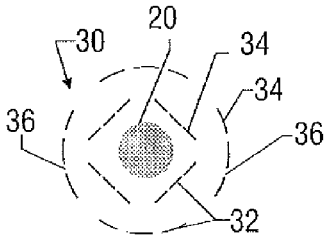
Figure 18L:
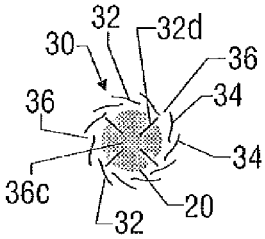

In the embodiments of FIGS. 18C-18E, the preferred direction of separation is either from Left to Right or Right to Left. Cuts 32 are provided on both the left and right sides of each respective adhesive spot 20. Thus, either trialing side 24 of the adhesive spots 20 will have cuts 32 when a preferred direction of separation is implemented. FIGS. 18F, 18H and 181 illustrate various configurations of weakened areas 30 having cuts 32 on multiple sides of the respective adhesive spot 20 to assist in separation control when the separation direction is toward any of such cuts 32. FIGS. 18J-18L include embodiments of weakened areas 30 having cuts 32 generally surrounding the adhesive spot 20, such as to assist in separation control regardless of the direction of separation.

Figure 19:
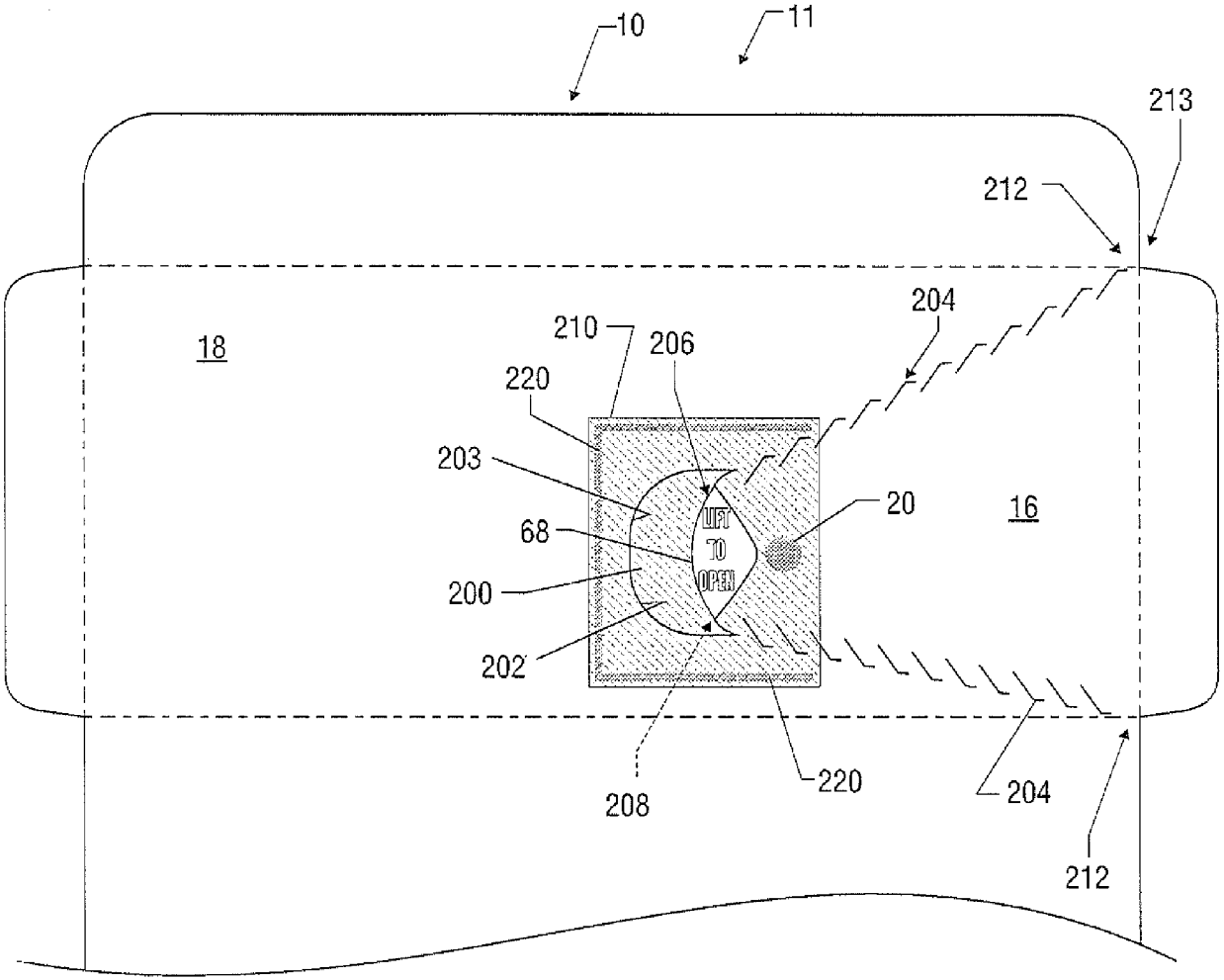
FIG. 19 is a front view of an exemplary envelope-type container in a pre-folded state that includes an embodiment of a separable portion in accordance with the present disclosure.

Now referring to the embodiment of FIG. 19, at least one of the first and second portions 16, 18 of the container 10 is shown including one or more cut-outs 200 and, if desired, one or more patch 210 extending at least partially across the cut-out 200. The cut-out 200 may have any desired shape, configuration and purpose. As used herein, the term "cut-out" means an area, space or opening formed by the removal or moving of a container portion or component, such as part of the second container portion 18. In the example shown, the cut-out 200 is a small die-cut window 202 formed in the second portion 18 by an edge 203 of the second portion 18. The cut-out may also have any desired purpose. For example, the cut-out 200 may be formed for the purpose of providing easy access to the loose end 206 of the first portion 16, as will be described further below. For another example, the cut-out 200 may also/or instead be formed to display visible information, such as a mailing address or a contents list (e.g. on food product containers).

Likewise, the patch 210 may have any desired construction, shape, configuration and purpose. The patch 210 of FIG. 19 is constructed of envelope window material, such as a sheet of transparent cellophane, cellulose or paper-based material, glued with sealer 220 around three sides of its perimeter to the inside surface (not shown) of the second portion 18. However, the patch 210 may be affixed to the container 10 on more or less than three of its sides and in any desired manner. The sealer 220 may be glue, tape, adhesive, remoistenable gum or glue, contact gum or glue, latex gum, peel-n-seal tape, two-sided tape, fugitive adhesive, any combination thereof or any other suitable material or mechanism as is or becomes known. The patch 210 may protect contents of the container 10, prevent the entry of material into the container 10 through the cut-out 200, secure the contents within the container, display visible information or any other desired purpose. It should be understood, however, that the cut-out 200, patch 210 and sealer 220 are in no way limiting upon the present disclosure or appended claims.

Still referring to FIG. 19, in accordance with an independent aspect of the present disclosure, the first portion 16 of this embodiment serves as an opening, or at least partially separable, section of the container 10, and the illustrated second portion 18 represents the remainder of the container 10. The first portion 16 of this example is least partially defined by a pair of tear lines 204 that each intersect or nearly intersect the edge 203 of the second portion 18 at the cut-out 200. As used herein, the term "intersect" means to cross, engage, contact or to be located proximate to. The tear lines 204 of this example allow the first portion 16 to be at least partially separable from the second portion 18, such as to provide quick and/or easy access into the container 10 or information provided beneath the first portion 16, or for any other desired purpose. However, the present disclosure is not limited to the use of two tear lines 204, but may include a single tear line 204 (e.g. FIG. 25) or more than two tear lines 204.

Referring again to FIG. 19, in this embodiment, a sleeve-like or slot-like opening 208 is formed between the first portion 16 and the patch 210. The loose end 205 of the first portion 16 is located at the front of the opening 208 and over the patch 210. At the opening 208, the exemplary loose end 205 may be gripped to enable the first portion 16 to be (at least partially) separated from the second portion 18 along the tear lines 204. If desired, a tab 68 may be included at the loose end 206 of the first portion 16, such as to allow easy gripping and separation of the first portion 16. In the example shown, the tab 68 includes the instructions "LIFT TO OPEN" printed thereon.

If desired, the first portion 16 may be reconnectable to the second portion 18, such as by inserting the loose end 205 into a slit (not shown) formed in the patch 210, or in any other desired manner. This may be suitable for containers 10 that have continued or multiple uses, such as food packaging containers (not shown).

Figure 23:
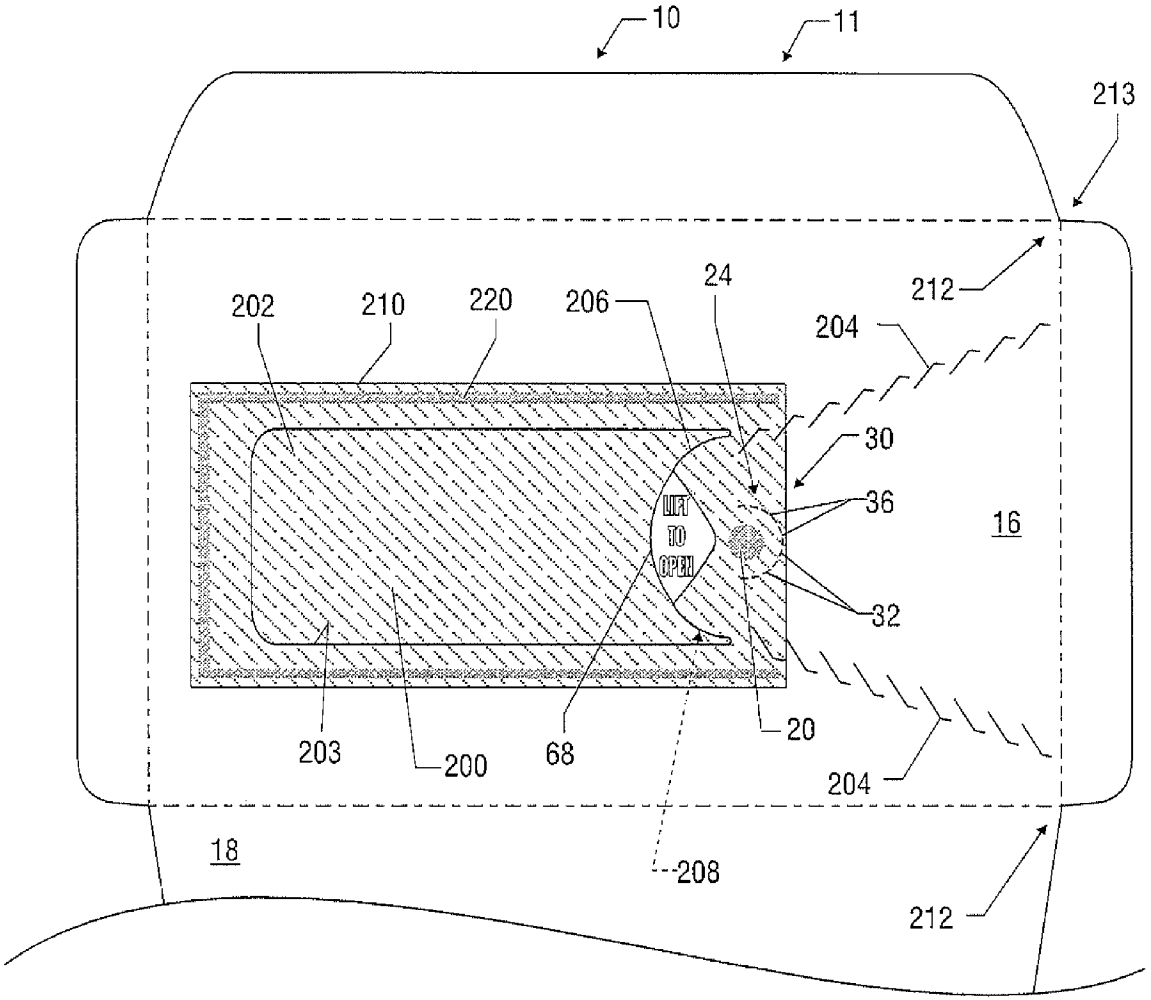
FIG. 23 is a front view of another exemplary envelope-type container in a pre-folded state that includes an embodiment of a separable portion in accordance with the present disclosure.

The tear line(s) 204 may have any suitable form and configuration. In this example, the tear lines 204 are scalloped perforations that extend angularly from the cut-out 200 to the corners 212 of the side 213 of the container 10, which is an envelope 11. Extending to the corners 212, the tear lines 204 allow the first portion 16 to be separated from the second portion 18 across the entire width of the envelope 11, such as to allow easy removal of its contents or any other purpose. If desired, another tear or perforation line (not shown) could be included along the side 213 or elsewhere to allow the first portion 16 to be completely removed. For another example, the tear lines 204 of the embodiment of FIG. 23 extend angularly from the cut-out 200 to the side 213 of the container 10 between its corners 212. This and similar configurations may be used to expose or give access to information provided in the container 10 below the first portion 16, such as an advertisement, picture, graphic, amount due, bank balance, password, etc., or any other desired purpose.

Figure 25:
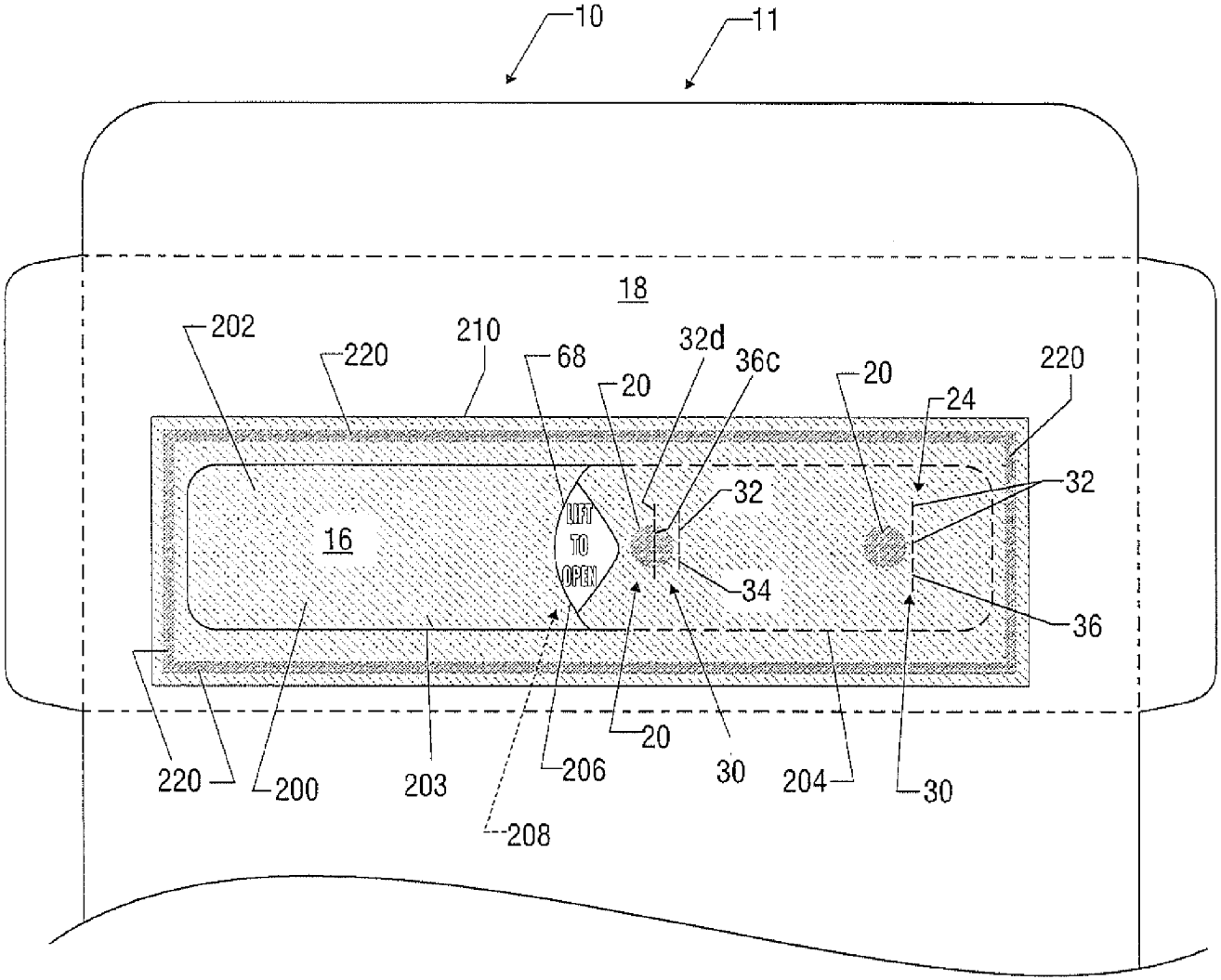
FIG. 25 is a front view of another exemplary envelope-type container in a pre-folded state that includes an embodiment of a separable portion in accordance with the present disclosure.
Figure 26A:
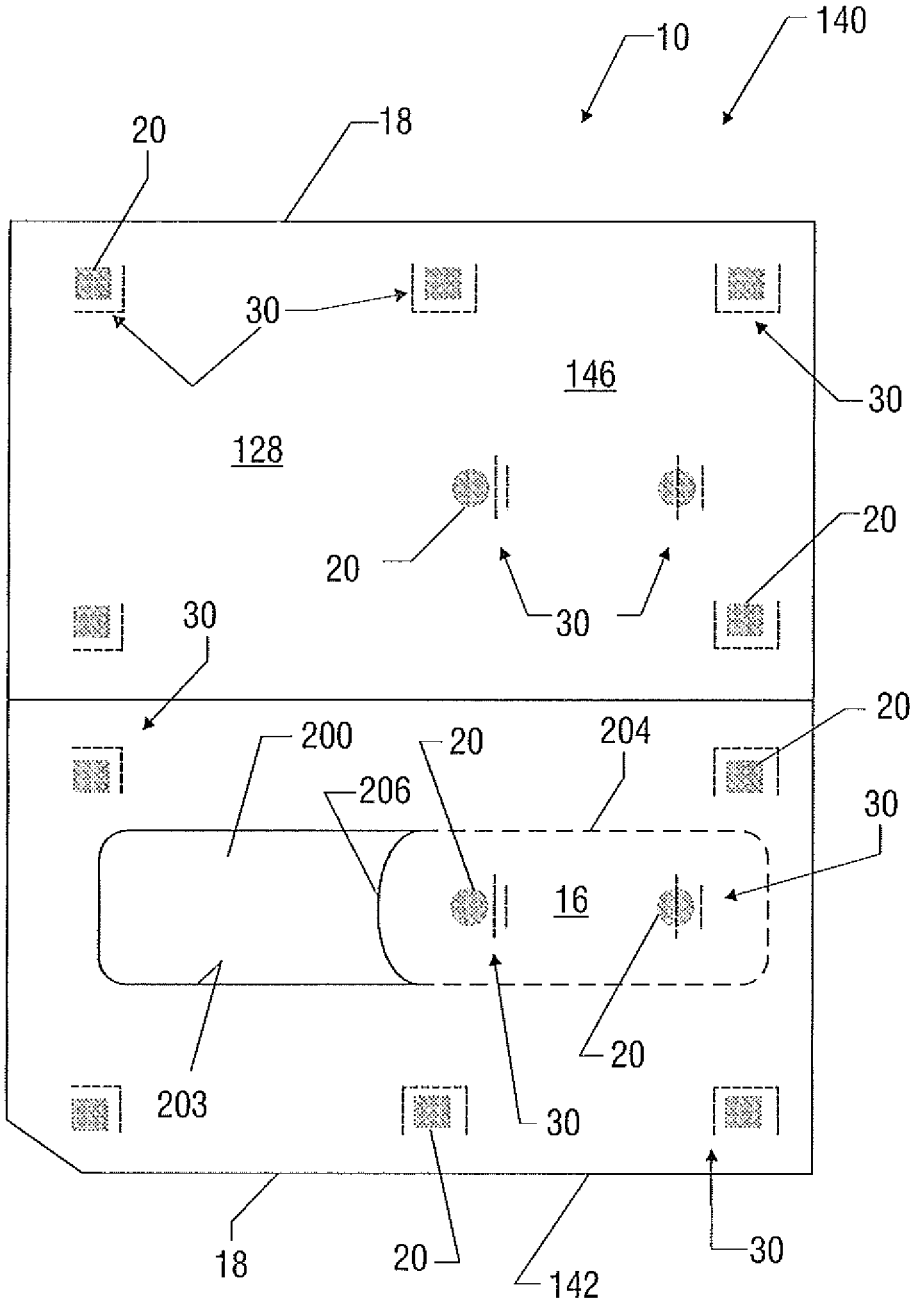
FIG. 26A is a back view of an exemplary folded-form type container in a pre-folded state that includes an embodiment of a separable portion and various additional embodiments of adhesive spots with weakened areas in accordance with the present disclosure.
Figure 26B:
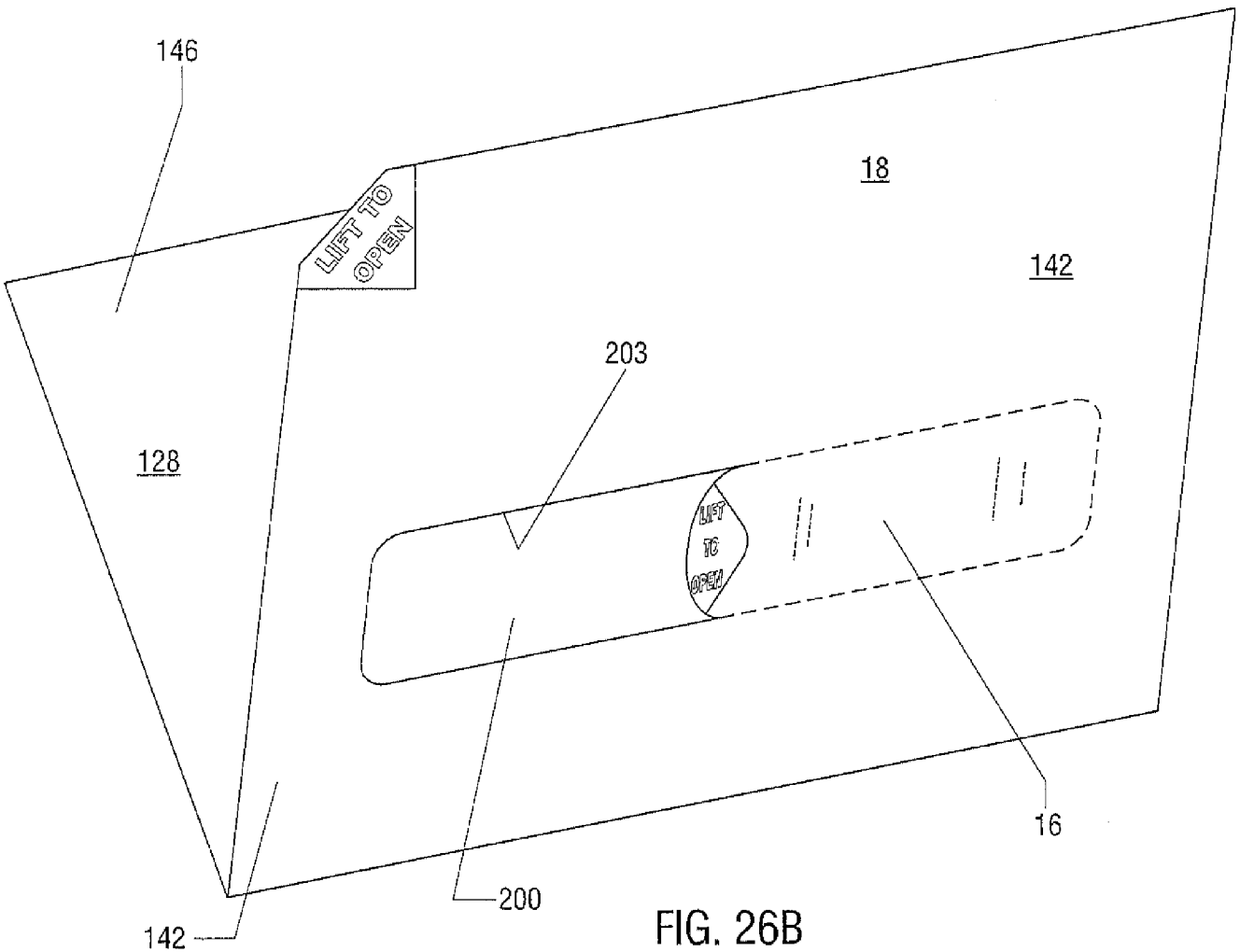
FIG. 26B is a perspective view of the exemplary folded-form type container of FIG. 26A in a partially folded state.
Figure 26C:
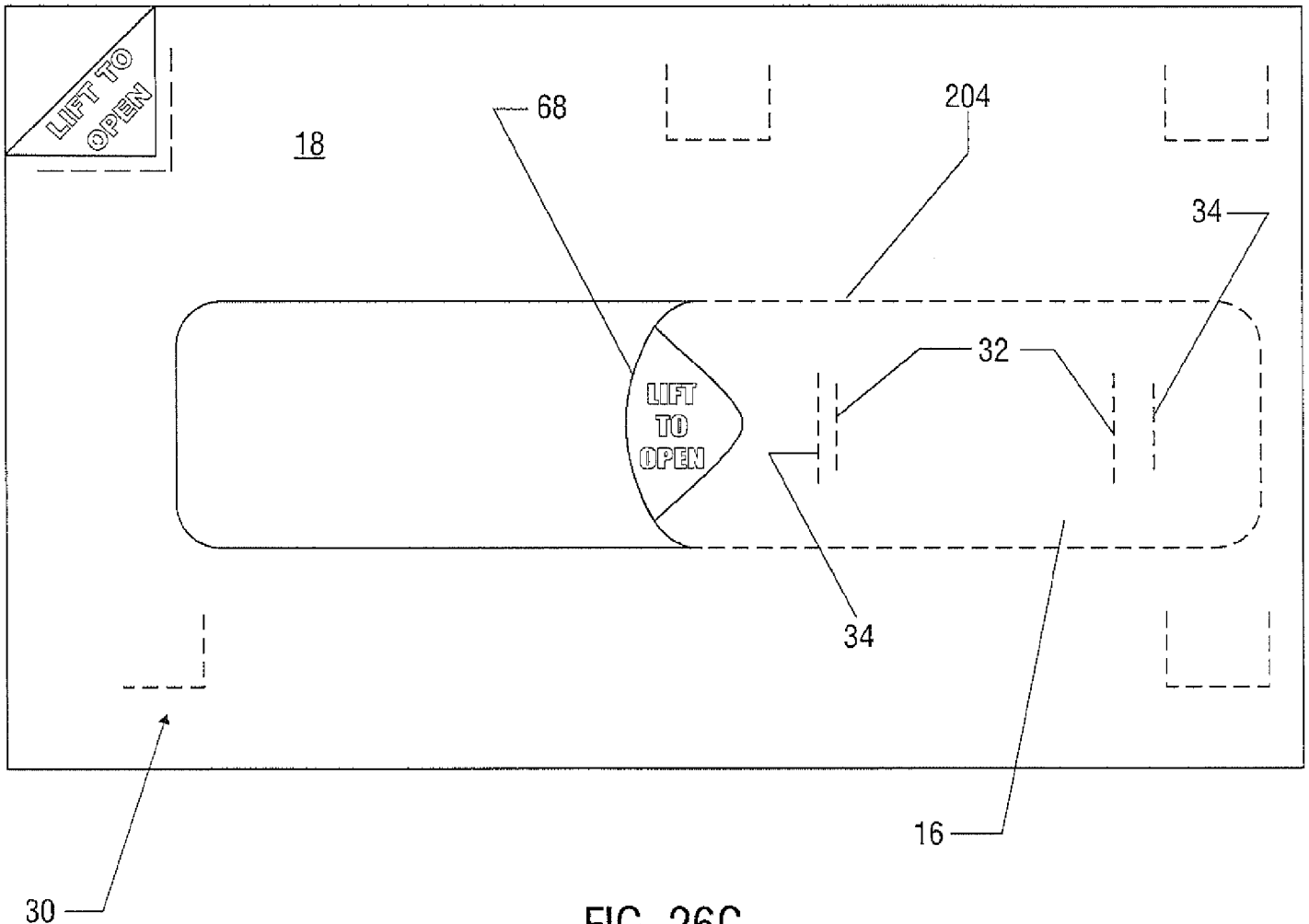
FIG. 26C is a front view of the exemplary folded-form type container of FIG. 26A in a folded state.
Figure 26D:
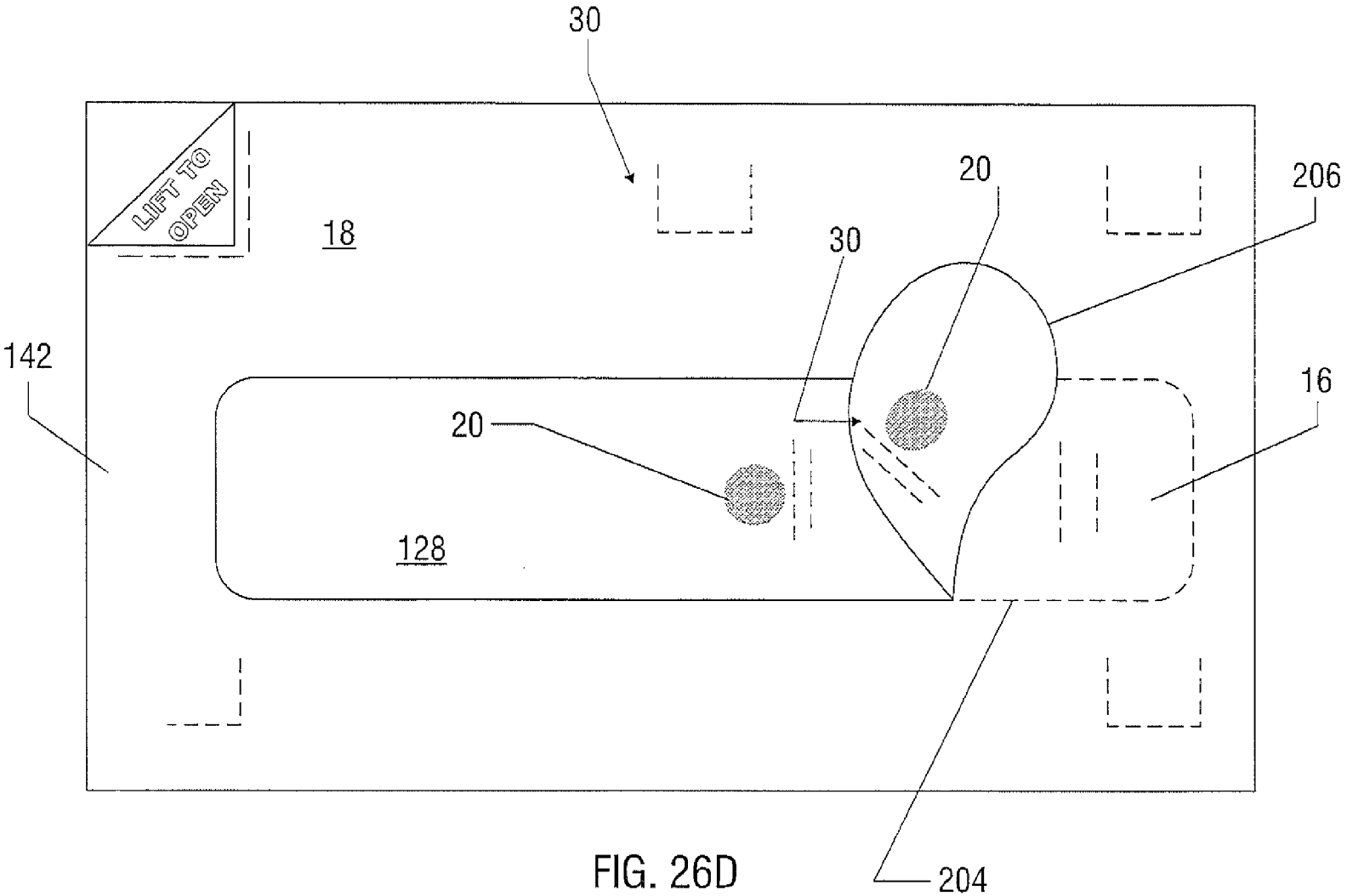
FIG. 26D is a front view of the exemplary folded-form type container of FIG. 26A showing the exemplary separable portion in a partially separated state.

For yet another example, in the embodiment of FIG. 25, a single looped or rectangular-like tear line 204 defining the first portion 16 aligns at its ends with the edge 203. The first portion 16 of this embodiment is thus entirely disposed over the patch 210 and completely separable from the second portion 18. Further, the separation and removal of the illustrated first portion 16 forms an extension of the cut-out 200. If the patch 210 is transparent, the removal of the first portion 16 displays or reveals whatever was below the first portion 16. This and similar configurations may be used to give access to information provided below the first portion 16, and may provide the first portion 16 to be used as a removable form, label, sticker, payment stub, coupon, reply card, retail store card, ID card or other component, or for any other desired purpose.

Referring back to the embodiment of FIG. 19, at least one adhesive spot 20 is included between the first container portion 16 and the patch 210. When the container 10 is assembled, the illustrated adhesive spot 20 is capable of temporarily adhering the patch 210 and the first portion 16 together proximate to the cut-out 200. When desired, the first portion 16 is separable from the patch 210 at the adhesive spot 10.

The adhesive spot(s) 20 make have any suitable shape, configuration and composition. If desired, the adhesive spot 20 may be formed to disengage between the first portion 16 and patch 210 without substantially damaging them. Further, if the adhesive spot 20 is engaged to a section of the first portion 16 that is constructed of material that is fibrous or more fibrous than the patch 210, the first portion 19 and patch 210 may be separated without substantial damage or defacement to the patch 210. As used herein, the term "fibrous" means made at least partially of paper or a paper-based composite or substrate, wood pulp, rags, straw or other material so that it may potentially shred, tear or yield at an adhesive spot when separated or pulled apart from another item or component. In the embodiment shown, the adhesive spot 20 is constructed of mailing glue formed in a generally circular shape with a standard thickness for use on paper envelopes. This configuration sufficiently secures the first portion 16 to the patch 210, while allowing the easy and relatively damage-free release thereof. For another example configuration, in the embodiment of FIG. 22, the adhesive spot(s) 20 extends substantially or entirely across the width of the first portion 16. This type of configuration may be included, for example, to more fully block or seal the opening 208 and ensure little or no unwanted material enters the opening 208 or container 10, such as for use with food or industrial materials packaging (not shown).

Again referring back to FIG. 19, the adhesive spot(s) 20 may be included for any suitable reason. For example, the adhesive spot 20 may be included to (i) adequately secure the first portion 16 and patch 210 proximate to the opening 208, such as during handling and processing of the container and until it is desired to separate the first portion 16 from the second portion 18, and/or (ii) to allow the first portion 16 to be easily separated from the patch 210 without damaging the first portion 16 and/or the patch 210.

For another example, the adhesive spot 20 may be included to provide a close fit of the first portion and the patch 210, essentially closing or blocking the opening 208. This may be desirable, for example, to contribute to the stability of the container 10, secure the contents in the container 10, assist in preventing the inadvertent, mistaken or otherwise undesirable introduction of other items into the opening 208 or separation of the first and second portions 16, 18, such as during handling and processing of the container 10.

For yet another example, when the container 10 is an envelope or other mail piece, the adhesive spot(s) 20 may be included to assist in preventing the first portion 16 from catching on other mail pieces and equipment during mail sorting, processing and handling. Without the adhesive spot(s) 20, there is a greater risk the loose end 206 of the first portion 16 of this embodiment may get hung up at various locations in the automated mail processing equipment (e.g. insertion station, transfer station, feed and delivery stations, etc.), which may cause damage to or premature opening of the container 10 and other mail pieces, interruption of the mail processing operations or damage to the equipment. Also, as the container 10 moves through the mail-stream, other mail pieces will contact the cut-out 200, patch 210 and/or loose end 206 of the first portion 16. If the first portion 16 is not secured to the patch 210, other mail pieces are more likely to catch or get hung up on the loose end 206 or slide into the opening 208 between the patch 210 and the first portion 16, increasing the risk of inadvertent opening or damage to the container 10 and other mail pieces, as well as mail jams that can halt production or make the container 10 undeliverable. Further, the U.S. Post Office may have rules and regulations that disallow or discourage the presence of openings in mail pieces, such as requiring that mail pieces be sealed on all sides. Thus, the adhesive spot(s) 20 may be included to provide stability and security of the container 10, aid in making the container 10 compatible with machine processing and mail regulations, support the reliable handling thereof, a combination thereof or other desired purpose.

Figure 20A:
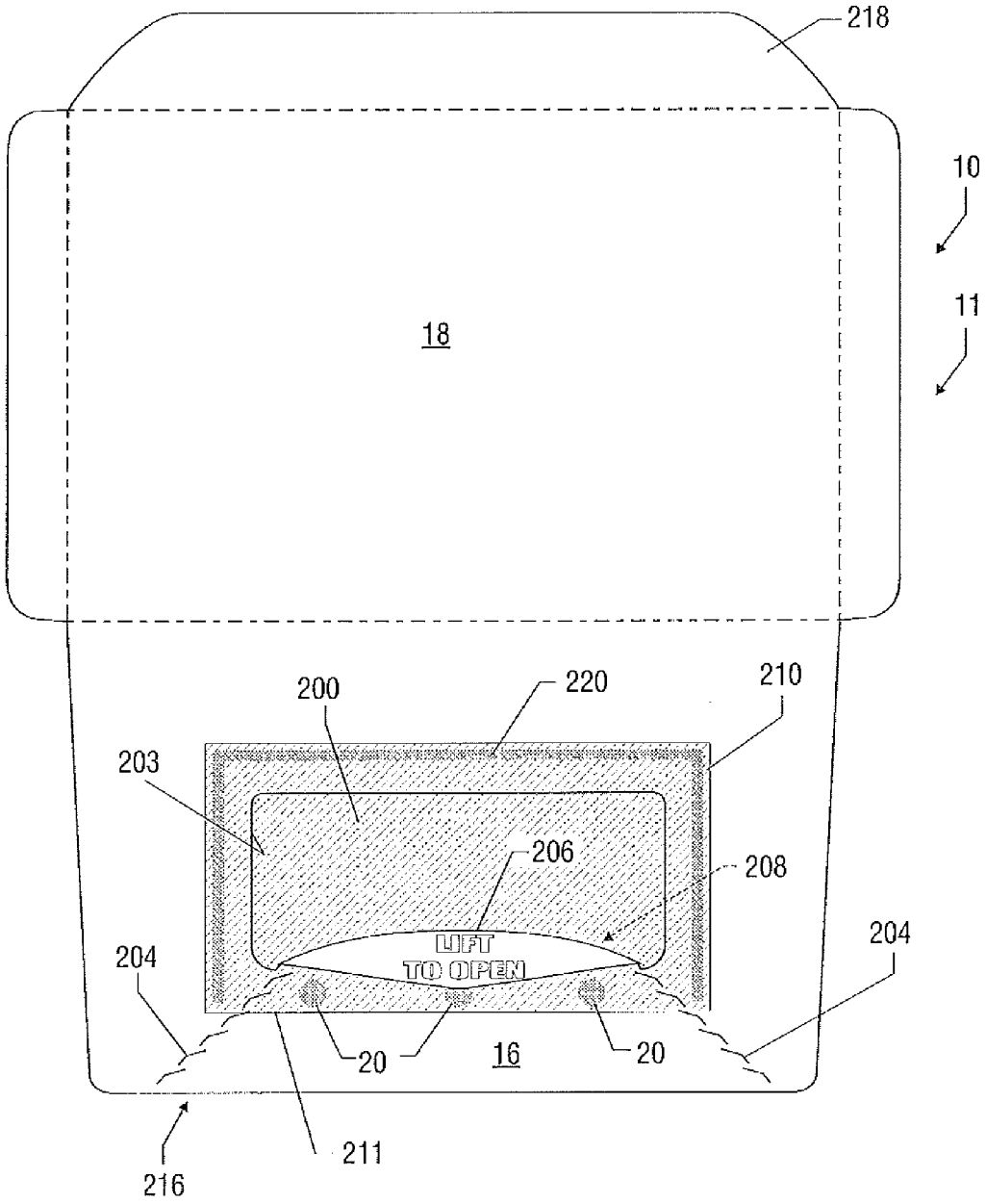
FIG. 20A is a front view of another exemplary envelope-type container in a pre-folded state that includes an embodiment of a separable portion in accordance with the present disclosure.

In the embodiment of FIGS. 20A and 208, the container 10 is also an envelope 11. A pair of tear lines 204 extends angularly downwardly toward the bottom corners 214 of the container 10. Multiple adhesive spots 20 are shown holding the first portion 16 and the patch 210 together. In this example, the adhesive spots 20 provide an additional purpose of allowing the effective filling of the envelope 11. Without the adhesive spot(s) 20, when contents are inserted into the envelope 11 (through the envelope mouth 216), the contents are more likely to catch on the edge 211 of the patch 210 between it and the first portion 16 inside the envelope 11, potentially damaging the container 10 and its contents or causing process interruption or other problems, particularly during automated filling of the envelope 11.

Figure 20B:
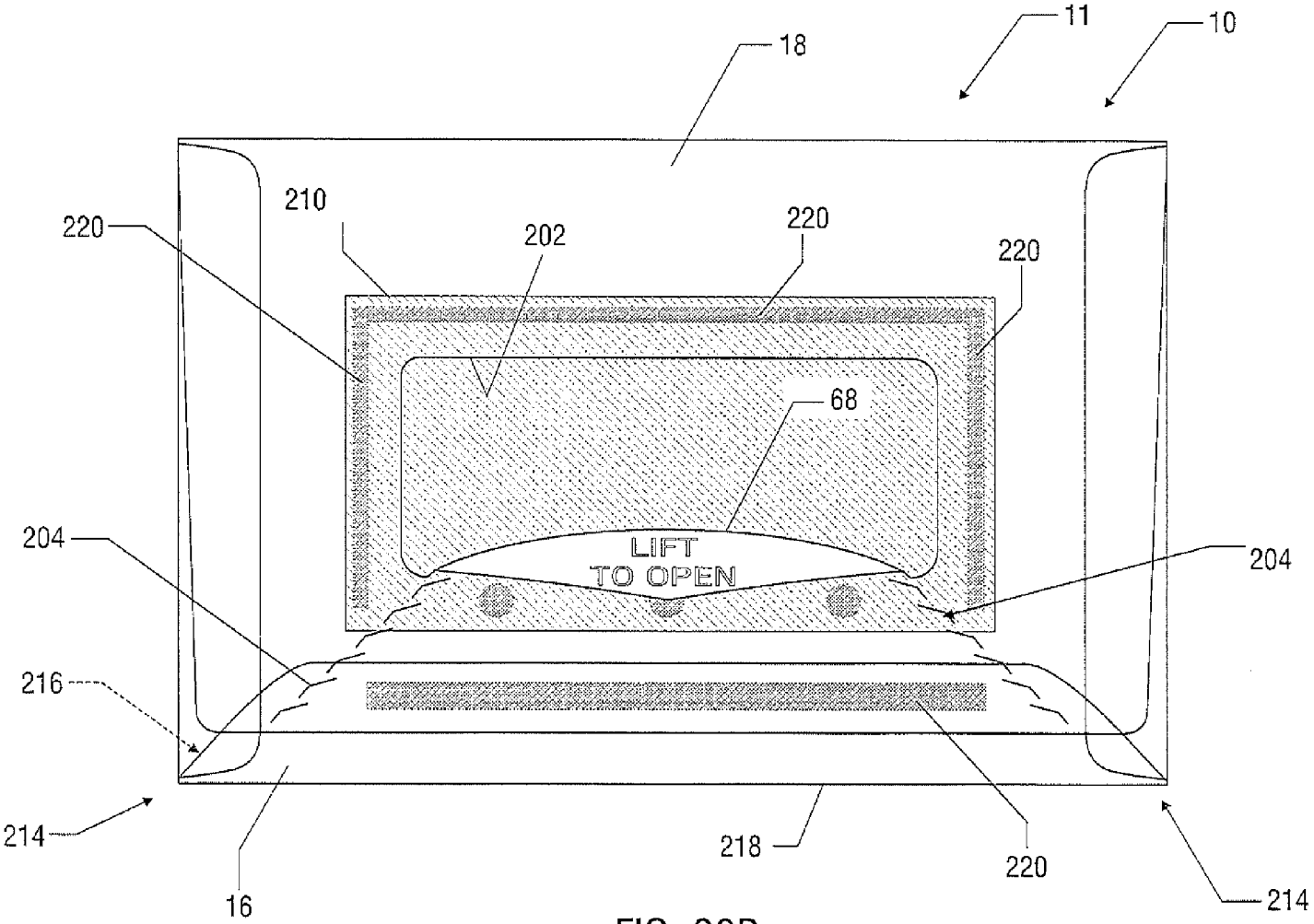
FIG. 20B is a front view of the container of FIG. 20A in a fully assembled state.

Still referring to the embodiment of FIGS. 20A and 20B, in another independent aspect of the present disclosure, when the illustrated envelope 11 is assembled, the seal flap 218 adheres to the outside surface of the first portion 16 with the use of one or more sealer 220. In this embodiment, the sealer 220 engages the first portion 16 between the tear lines 204. Thus, when the first portion 16 is separated from the second portion 18, the seal flap 218 will open due to its attachment to the first portion 16, opening the envelope 11.

Figure 21:
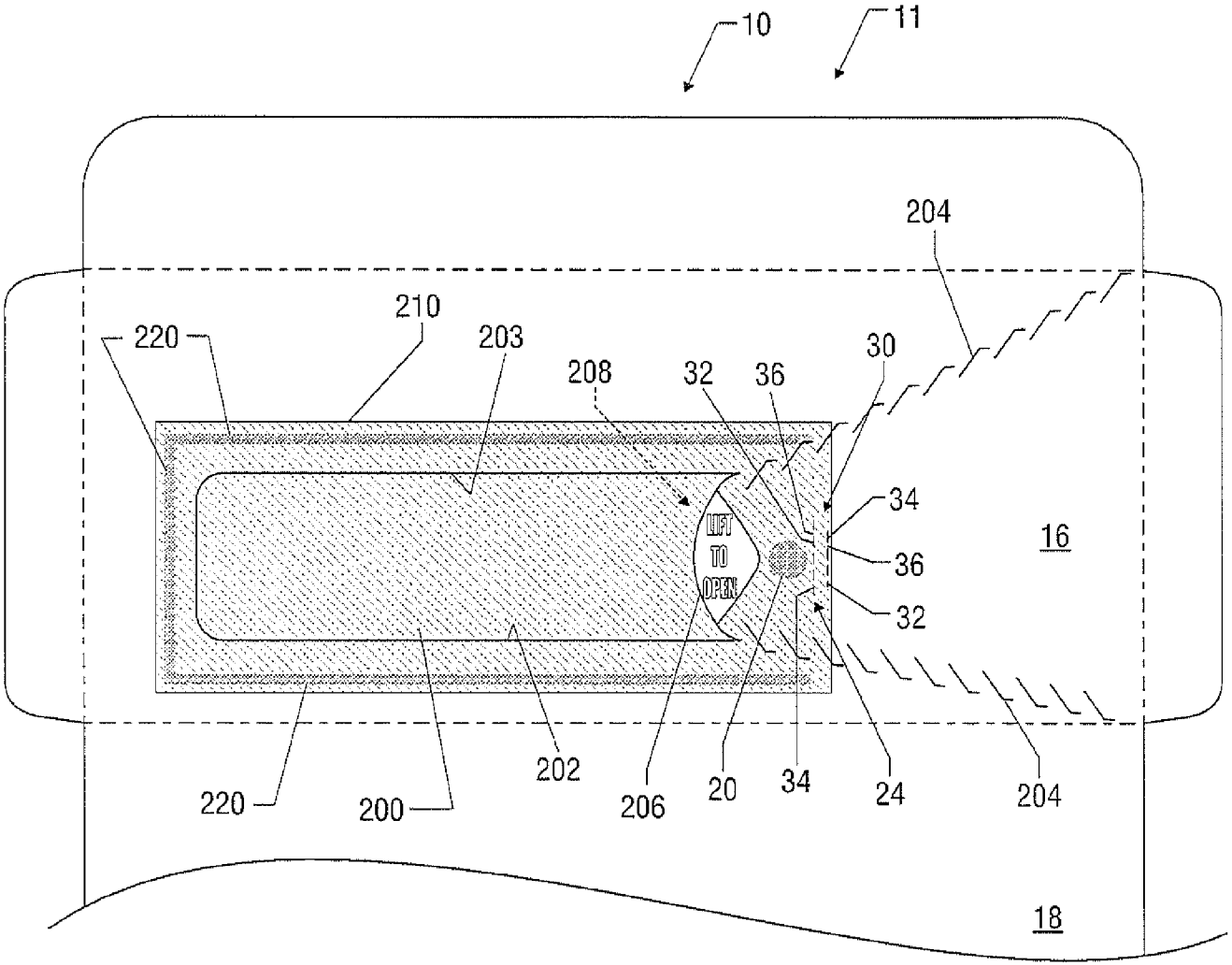
FIG. 21 is a front view of yet another exemplary envelope-type container in a pre-folded state that includes an embodiment of a separable portion in accordance with the present disclosure.
Figure 22:
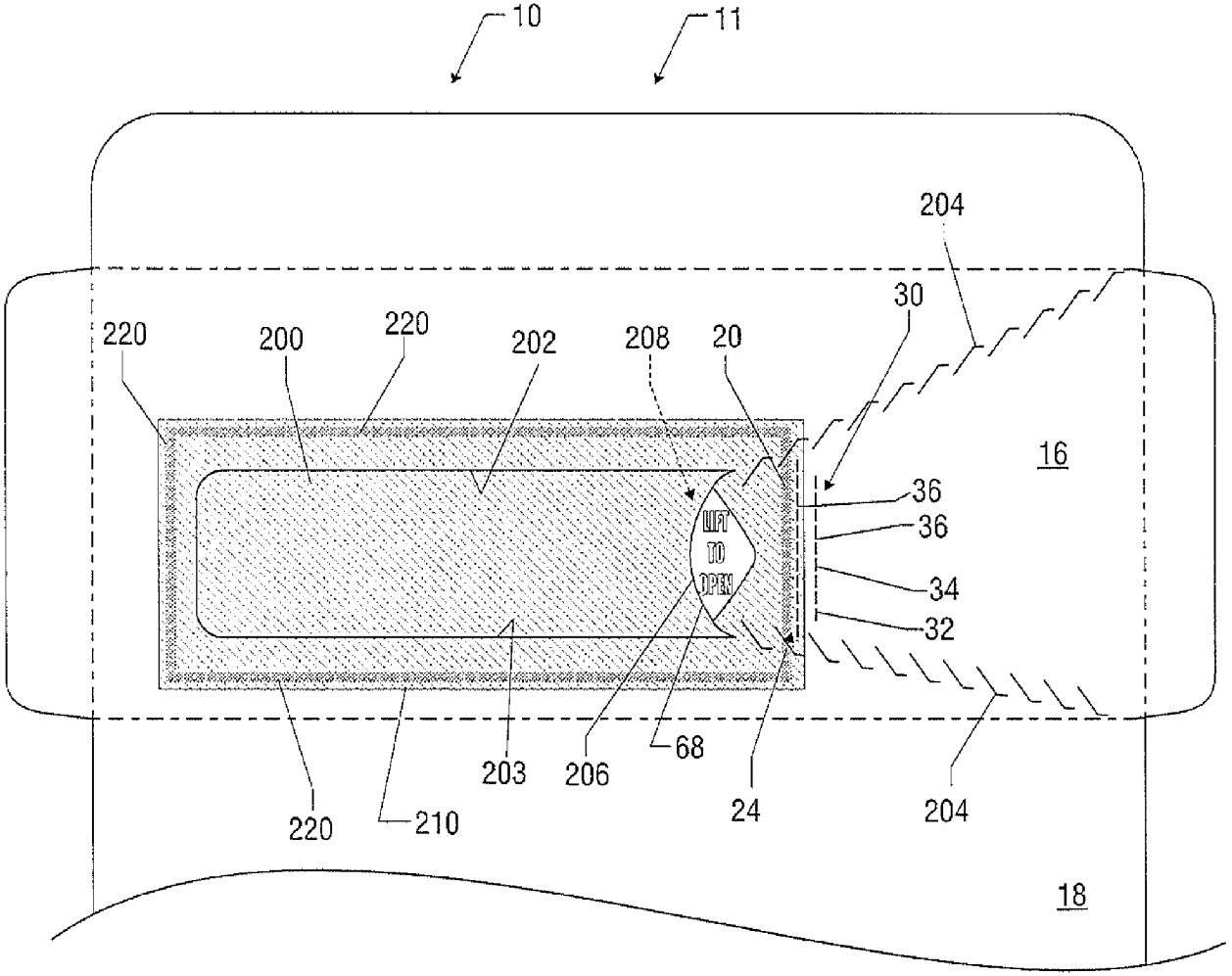
FIG. 22 is a front view of another exemplary envelope-type container in a pre-folded state that includes an embodiment of a separable portion in accordance with the present disclosure.
Figure 24A:
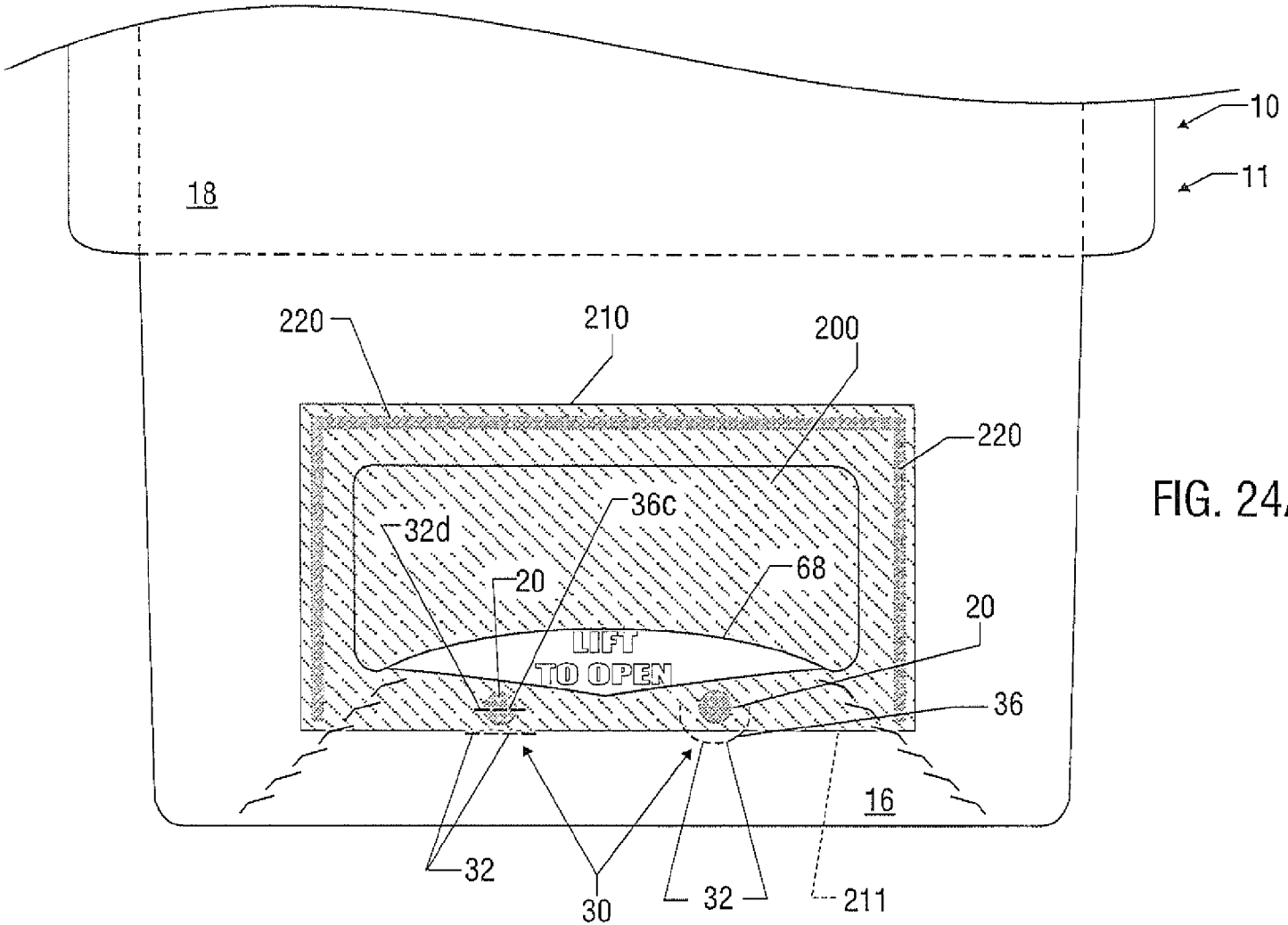
FIG. 24A is a front view of another exemplary envelope-type container in a pre-folded state that includes an embodiment of a separable portion in accordance with the present disclosure.
Figure 24B:
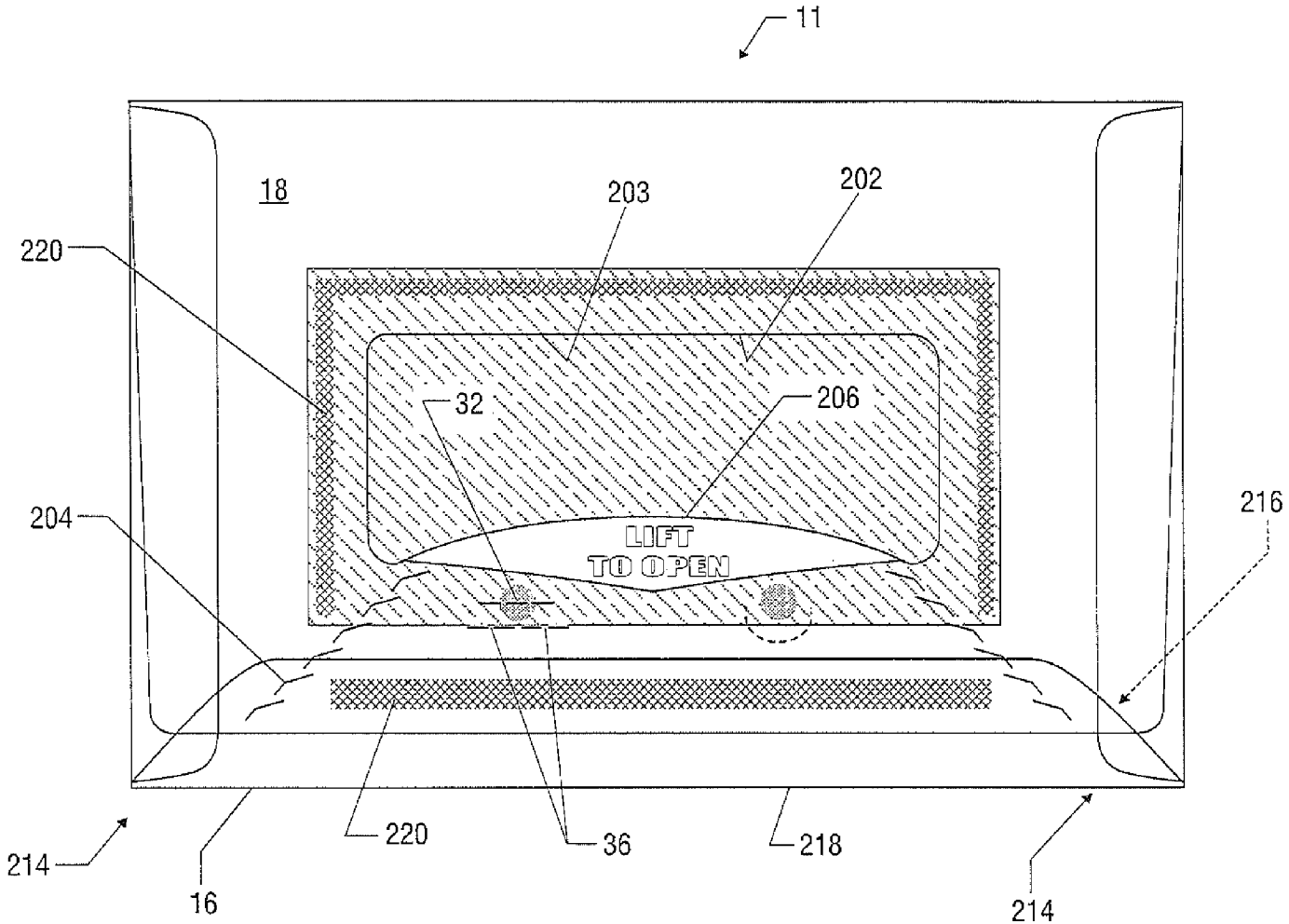
FIG. 24B is a front view of the container of FIG. 20A in a fully assembled state.

Now referring to, the embodiment of FIG. 21, in another independent aspect of the present disclosure, one or more weakened areas 30 may be formed in the first portion 16 of the container 10 proximate to the adhesive spot(s) 20 to provide separation control or any other desired purpose. The weakened area(s) 30 may have any desired shape, configuration and orientation. In this embodiment, the weakened area 30 includes adjacent linearly aligned overlapping cuts 34 formed into the first portion 16 on the trailing side 24 of a circular shaped adhesive spot 20. For another example, FIG. 22 shows a weakened area 30 having adjacent linearly aligned overlapping cuts 34 formed into the first portion 16 on the trailing side 24 of an elongated adhesive spot 20. The embodiment of FIG. 23 includes a weakened area 30 having a single line of multiple short cuts 32 and corresponding short connectors 36 formed into the first portion 16 in a generally arcuate pattern adjacent to and around part of the adhesive spot 20 on its trailing side 24. The embodiment of FIGS. 24A and 24B includes two adhesive spots 20 and corresponding weakened areas 30 having differing configurations. The leftmost weakened area 30 includes a set of integrated cuts 32*d* and connectors 36*c* and a line of cuts 32 on the trailing side 24 of the adhesive spot 20. The other weakened area 30 is formed in a pattern similar to the arrangement of the embodiment of FIG. 23. The embodiment of FIG. 25 also includes two adhesive spots 20 and corresponding weakened areas 30 having differing configurations.

In another independent aspect of the present disclosure, referring to the embodiment of FIGS. 26A-D, the first portion 16 of the container 10 may not be adhered to a patch. In this embodiment, the container 10 is a foldable form 140 that includes a cut-out 200 without a patch. Thus, the illustrated adhesive spots 20, constructed of pressure seal gum or glue or any other desired material, adhere the first portion 16 to the inside surface 128 of the second portion 18. However, the first portion 16 may be adhered to another portion of the container 10, such as an insert (not shown), or any other desired component.

Still referring to FIGS. 26A-D, the first portion 16 of this example is otherwise similar to the first portion 16 of FIG. 25 (except for having different weakened area 30 patterns). The second portion 16 of the illustrated container 10 includes front and back foldable panels 142, 146, which have a series of opposing adhesive spots 20 (constructed of pressure seal gum or glue or any other desired material) and corresponding weakened areas 30 to allow the form 140 itself to be opened.

Figure 27A:
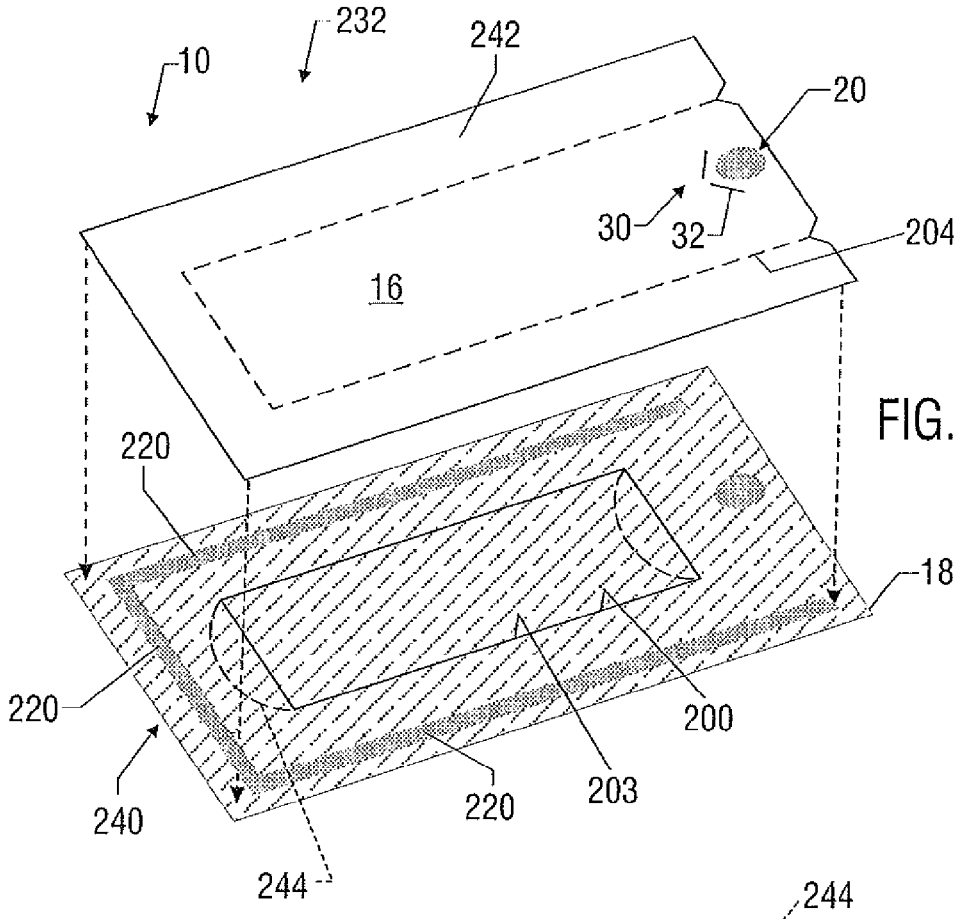
FIG. 27A is a bottom view of the first and second portions of an exemplary package type container in a pre-assembled state that includes an embodiment of a separable portion in accordance with the present disclosure.
Figure 27B:
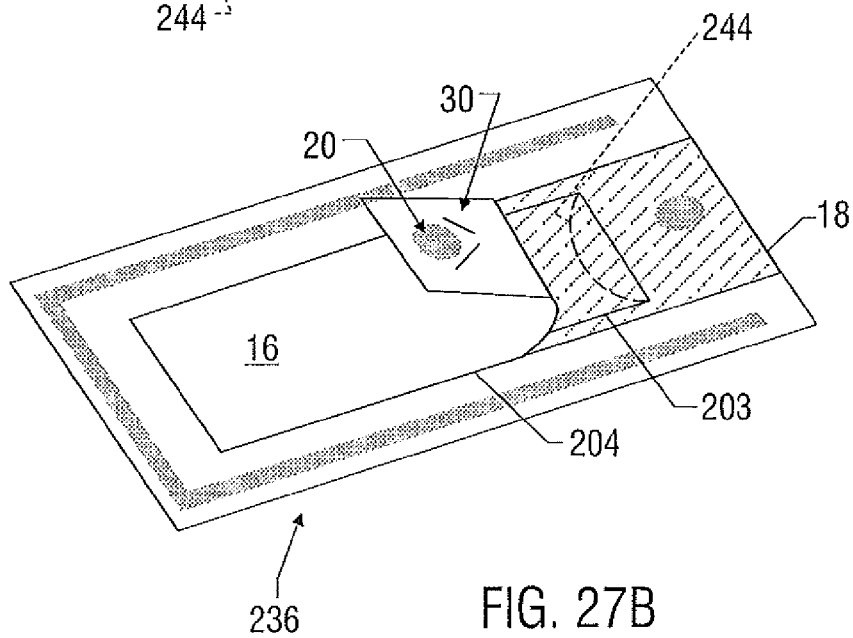
FIG. 27B is a bottom view of the exemplary package type container of FIG. 27A in an assembled state and showing the exemplary separable portion in a partially separated state.

In the embodiment of FIGS. 27A-B, the container 10 is a package 232. For example, the package 232 may be a blister pack 236 for the retail sale of a product, such as batteries (not shown). The first portion 16 of the illustrated package 232 is a backing 242 and the second portion 18 is a carrier section 240. The first and second portions 16, 18 are connected together, such as with a sealer 220. The second portion 18 includes a cut-out 200 formed by an edge 203. Protruding from the edge 203 is a molded clam-shell or bubble section 244, within which one or more items, such as products (e.g. batteries), may be carried.

Still referring to the embodiment of FIGS. 27A-B, the first portion 16 of the container 10 is formed by one or more tear line 204 aligned over the edge 203. The illustrated first portion 16 thus provides a back wall for the bubble section 244. The first and second portions 16, 18 are shown connected together with at least one adhesive spot 20, constructed of a pressure heat-seal gum or glue or other material; and the illustrated first portion 16 includes an associated weakened area 30.

In this embodiment, the first portion 16 is constructed at least partially of a fibrous material and the second portion 18 is molded plastic. When the illustrated container 10 is assembled, the adhesive spot 20 adheres the first and second portions 16, 18 together proximate to the cut-out 200 to provide security of the contents, prevent inadvertent separation of the first and second portions 16, 18 or undesirable material entry into the bubble section 244, or for any other desired purpose. When desired, the first portion 16 is separable from the second portion 18 along the tear line(s) 204 to provide quick and easy access to the contents of the bubble section 244 or any other purpose.

Preferred embodiments of the present disclosure thus offer advantages over the prior art and are well adapted to carry out one or more of the objects of the disclosure. It should be understood that all of the above components and any other components that may be included may have any suitable, desired size, material construction, configuration, form and quantity, as is or becomes known. The present disclosure is in no way limited to the components, configurations, dimensions, specific examples or other details described above or shown in the attached figures. Further, the above-described features are not limited to the details as described and shown. Yet further, each such feature can be used independent of any other feature. Moreover, the present disclosure does not require each of the above features and includes further capabilities, functions, methods, uses and applications, as will be apparent to a person skilled in the art based upon the description above and the appended drawings and claims.

While preferred embodiments have been shown and described, many variations, modifications and/or changes, such as in the components, details of construction and operation, arrangement of parts and/or methods of use, are possible, contemplated by the patentee, within the scope of the appended claims, and may be made and used by one of ordinary skill in the art without departing from the spirit or teachings of the disclosure and scope of appended claims. Thus, all matter herein set forth or shown in the accompanying drawings should thus be interpreted as illustrative and not limiting. Accordingly, the scope of this disclosure and the appended claims is not limited to the embodiments described and shown herein.

What is claimed is:

1. A container having at least two portions being partially separable comprising:

a first container portion having a loose end;

a second container portion being attached to said first container portion except at said loose end and including a cut-out formed by at least one edge of said second container portion adjacent said loose end;

a patch extending at least partially across said cut-out, said patch being secured directly to said second container portion;

a tear line extending between said first and second container portions and at least partially defining said first container portion, said tear line having one end in close proximity to said loose end;

an adhesive spot positioned on said first container portion adjacent said loose end and releasably attaching said loose end to one of said second container portion, said patch secured to said second container portion and an insert positioned in the container, whereby said first container portion is releasable at said adhesive spot and at least partially separable from said second container portion along said tear line, said patch not being secured directly to said first container portion except by said adhesive spot when said loose end is releasably attached to said patch by said adhesive spot; and at least one weakened area formed in said first container portion proximate said adhesive spot, wherein said at least one weakened area assists in the at least a partial separation and the release of said first container portion from the one of said second container portion, said patch and said insert, and said at least one weakened area is formed in a pattern of at least one line of multiple cuts separated by corresponding connectors to prevent detachment of a part of said first container portion on which said adhesive spot is positioned from a remainder of said first container portion as said first portion is separated from said second portion along said tear line.

2. The container according to claim 1 wherein said at least one said weakened area includes said at least one line on a trailing side of said adhesive spot.

3. The container according to claim 2 wherein said at least one said weakened area includes said at least one line with said cuts being integrated cuts extending through or at least partially across said adhesive spot.

4. The container according to claim 1 wherein said first container portion is only partially separable from said second container portion, and wherein said first container portion forms a flap that is reconnectable to said second container portion for reuse of the at least one container.

5. The container according to claim 1 wherein said first container portion is entirely separable from said second container portion.

6. The container according to claim 1 further including a tab formed at said loose end to allow said first container portion to be easily gripped by human fingers.

7. The container according to claim 1 wherein the container has top, bottom, left and right edges, wherein said tear line includes first and second tear lines extending angularly toward respective upper and lower corners of either of said left and right edges of the container.

8. The container according to claim 1 wherein the container has top, bottom, left and right edges, wherein said tear line includes first and second tear lines extending at least partially generally parallel to said top and bottom edges toward either of said left and right edges of the container.

9. A container having at least two portions being partially separable comprising:

a first container portion having a loose end;

a second container portion being attached to said first container portion except at said loose end and including a cut-out formed by at least one edge of said second container portion adjacent said loose end;

a patch extending at least partially across said cut-out, said patch being secured directly to said second container portion;

a tear line extending between said first and second container portions and at least partially defining said first container portion, said tear line having one end in close proximity to said loose end;

an adhesive spot positioned adjacent said loose end and releasably attaching said loose end to said patch, whereby said first container portion is releasable at said adhesive spot and at least partially separable from said second container portion along said tear line, said patch not being secured directly to said first container portion except by said adhesive spot; and at least one weakened area formed in said first container portion and proximate said adhesive spot, wherein said at least one weakened area assists the at least partial separation and the release of said first container portion from said patch, and said at least one weakened area is formed in a pattern of at least one line of multiple cuts separated by corresponding connectors to prevent detachment of a part of said first container portion on which said adhesive spot is positioned from a remainder of said first container portion as said first portion is separated from said second portion along said tear line.

10. The container according to claim 9 wherein said at least one said weakened area includes said at least one line on a trailing side of said adhesive spot.

11. The container according to claim 9 wherein said first container portion is only partially separable from said second container portion, and whereby said first container portion forms a flap that is reconnectable to said second container portion for reuse of the container.

12. The container according to claim 9 wherein said first container portion includes at least one section constructed at least partially of a fibrous material.

13. The container according to claim 9 wherein said first container portion is entirely removable from said second container portion.

14. The container according to claim 9 wherein said first container portion is at least partially detachable from said second container portion along another tear line.

15. The container according to claim 9 whereby when said adhesive spot is released from said patch and said first container portion is detached from said second container portion, said detached first container portion can be attached to an object by said adhesive spot.

* * * * *